United States Patent [19]

Kato et al.

[11] Patent Number: 5,009,975

[45] Date of Patent: Apr. 23, 1991

[54] ELECTROPHOTOGRAPHIC PHOTORECEPTOR

[75] Inventors: Eiichi Kato; Kazuo Ishii, both of Shizuoka, Japan

[73] Assignee: Fuji Photo Film Co., Ltd., Kanagawa, Japan

[21] Appl. No.: 417,105

[22] Filed: Oct. 4, 1989

[30] Foreign Application Priority Data

Oct. 4, 1988 [JP] Japan ..... 63-248949
Nov. 17, 1988 [JP] Japan ..... 63-288972

[51] Int. Cl.[5] ..... G03G 5/08
[52] U.S. Cl. ..... 430/96; 430/49
[58] Field of Search ..... 430/96, 49, 57, 58

[56] References Cited

U.S. PATENT DOCUMENTS 4,853,307 8/1989 Tam et al. ..... 430/96
4,871,638 10/1989 Kato et al. ..... 430/96
4,952,475 8/1990 Kato ..... 430/96
4,954,407 9/1990 Kato et al. ..... 430/96

FOREIGN PATENT DOCUMENTS 0282275 9/1988 European Pat. Off. .
1806414 8/1969 Fed. Rep. of Germany .

*Primary Examiner*—John Goodrow
*Attorney, Agent, or Firm*—Sughrue, Mion, Zinn, Macpeak & Seas

[57] ABSTRACT

An electrophotographic photoreceptor comprising a support having thereon at least one photoconductive layer containing at least an inorganic photoconductive material and a binder resin, wherein the binder resin contains (A) at least one resin having a weight average molecular weight of from $1\times10^3$ to $3\times10^4$ with at least one substituent selected from the group consisting of $-PO_3H_2$, $-SO_3H$, $-COOH$, wherein R represents a hydrocarbon group having from 1 to 10 carbon atoms or —OR', wherein R' represents a hydrocarbon group having from 1 to 10 carbon atoms, and a cyclic acid anhydride-containing group, being bonded to one or both of the terminals of the polymer main chain thereof, and (B) at least one resin having a weight average molecular weight of $5\times10^4$ or more and containing, as a polymerization component, at least a repeating unit represented by formula (b-i):

(b-i)

wherein T represents —COO—, —OCO—, $-CH_2OCO-$, $-CH_2COO-$, —O— or $-SO_2-$; V represents a hydrocarbon group having from 1 to 22 carbon atoms; and $a_1$ and $a_2$, which may be the same or different, each represents a hydrogen atom, a halogen atom, a cyano group, a hydrocarbon group having from 1 to 8 carbon atoms, —COO—Z, or —COO—Z bonded via a hydrocarbon group having from 1 to 8 carbon atoms, wherein Z represents a hydrocarbon group having from 1 to 18 carbon atoms; and wherein said Resin (B) is partially cross-linked. The photoreceptor exhibits excellent electrostatic characteristics, image forming performance as well as printing suitability regardless of a change in environmental conditions or the kind of sensitizing dye used in combination with the photoreceptor.

9 Claims, No Drawings

ELECTROPHOTOGRAPHIC PHOTORECEPTOR

FIELD OF THE INVENTION

This invention relates to an electrophotographic photoreceptor, and more particularly to an electrophotographic photoreceptor having excellent electrostatic characteristics and moisture resistance, and, in particular, to an electrophotographic photoreceptor having excellent performance as a CPC photoreceptor.

BACKGROUND OF THE INVENTION

An electrophotographic photoreceptor may have various structures depending on the characteristics necessary or the electrophotographic processes employed.

A system in which a photoreceptor comprising a support having thereon at least one photoconductive layer and, if necessary, an electrically insulating layer on the surface thereof is widely employed. The photoreceptor composed of a support and at least one photoconductive layer is subjected to ordinary electrophotographic processing for image formation including charging, imagewise exposure, development and, if necessary, image transfer.

Electrophotographic photoreceptors have also been used widely as an offset printing plate precursor for direct printing plate making. In particular, a direct electrophotographic lithographic printing system has recently acquired a greater importance as a system providing hundreds to thousands of prints of high image quality.

Binders to be used in the photoconductive layer should per se have film-forming properties and the capability of dispersing photoconductive particles therein. Moreover, when formulated into a photoconductive layer, binders should exhibit satisfactory adhesion to a support. They are also required to have various electrostatic characteristics and image-forming properties, such that the photoconductive layer exhibits excellent electrostatic capacity, small dark decay and large light decay, hardly undergo fatigue before exposure, and maintain these characteristics in a stable manner against a change of humidity at the time of image formation.

Binder resins which have been conventionally used include silicone resins (see JP-B-34-6670) (the term "JP-B" as used herein refers to an "examined Japanese patent publication"), styrene-butadiene resins (see JP-B-35-1960), alkyd resins, maleic acid resins and polyamides (see JP-B-35-11219), vinyl acetate resins (see JP-B-41-2425), vinyl acetate copolymer resins (see JP-B-41-2426), acrylic resins (see JP-B-35-11216), acrylic ester copolymer resins (see JP-B-35-11219, JP-B-36-8510 and JP-B-41-13946), etc. However, electrophotographic photosensitive materials using these known resins suffer from a number of disadvantages, such as (1) poor affinity for photoconductive particles (poor dispersion of a photoconductive coating composition); (2) low charging properties of the photoconductive layer; (3) poor quality of the reproduced image, particularly dot reproducibility or resolving power; and (4) susceptibility of the reproduced image quality to influences from the environment a the time of electrophotographic image formation, such as a high temperature and high humidity condition or a low temperature and low humidity condition; and the like.

To improve the electrostatic characteristics of a photoconductive layer, various proposals have hitherto been made. For example, it has been proposed to incorporate into a photoconductive layer a compound containing an aromatic ring or a furan ring containing a carboxyl group or a nitro group, either alone or in combination with a dicarboxylic acid anhydride as disclosed in JP-B42-6878 and JP-B-45-3073. However, the thus improved photosensitive materials still have insufficient electrostatic characteristics, particularly, light decay characteristics. The insufficient sensitivity of these photosensitive materials has been compensated for by incorporating a large quantity of a sensitizing dye into the photoconductive layer. However, photosensitive materials containing a large quantity of a sensitizing dye undergo a considerable deterioration in whiteness, which means reduced quality as a recording medium, and sometimes deterioration of dark decay characteristics occurs, resulting in the failure to obtain a satisfactory reproduced image.

On the other hand, JP-A-60-10254 (the term "JP-A" as used herein refers to a "published unexamined Japanese patent application") suggests control of the average molecular weight of a resin to be used as a binder of the photoconductive layer. According to this suggestion, the combined use of an acrylic resin having an acid value of from 4 to 50 whose average molecular weight is distributed within two ranges, i.e., a range of from $1\times10^3$ to $1\times10^4$ and a range of from $1\times10^4$ and $2\times10^5$, would improve electrostatic characteristics, particularly reproducibility as a PPC photoreceptor on repeated use, moisture resistance and the like.

In the field of lithographic printing plate precursors using electrophotographic photoreceptor, extensive studies have been conducted to provide binder resins for a photoconductive layer having electrostatic characteristics compatible with printing characteristics. Examples of binder resins so far reported to be effective for oil desensitization of a photoconductive layer include a resin having a molecular weight of from $1.8\times10^4$ to $10\times10^4$ and a glass transition point of from 10° C. to 80° C. obtained by copolymerizing a (meth)acrylate monomer and a copolymerizable monomer in the presence of fumaric acid in combination with a copolymer of a (meth)acrylate monomer and a copolymerizable monomer other than fumaric acid as disclosed in JP-B-50-31011; a terpolymer containing a (meth)acrylic ester unit having a substituent having a carboxyl group at least 7 atoms distant from the ester linkage as disclosed in JP-A-5354027; a tetra- or pentapolymer containing an acrylic acid unit and a hydroxyethyl (meth)acrylate unit as disclosed in JP-A-54-20735 and JP-A-57-202544; a terpolymer containing a (meth)acrylic ester unit having an alkyl group having from 6 to 12 carbon atoms as a substituent and a vinyl monomer containing a carboxyl group as disclosed in JP-A-58-68046; and the like.

Nevertheless, these resins proposed have been proved by actual evaluations to be unsatisfactory for practical use in charging properties, dark charge retention, photosensitivity, and surface smoothness of the photoconductive layer.

The binder resins proposed for use in electrophotographic lithographic printing plate precursors were also proved by actual evaluations to give rise to problems relating to electrostatic characteristics, background staining of prints, and moisture resistance.

Further, known resins were found still to be insufficient to maintain performance properties in a stable manner regardless of considerable variations in environmental conditions of from high temperature and high humidity to low temperature and low humidity. In particular, an electrophotographic photoreceptor employed in a scanning exposure system using a semiconductor laser beam as a light source must possess higher electrostatic characteristic performance, particularly dark charge retention and photosensitivity, since the time of exposure is longer than that required in the case of conventional exposure to visible light over the entire surface thereof and also the exposure intensity is limited.

SUMMARY OF THE INVENTION

One object of this invention is to provide an electrophotographic photoreceptor having improved electrostatic characteristics, particularly dark charge retention and photosensitivity, and improved image reproducibility.

Another object of this invention is to provide an electrophotographic photoreceptor which forms a clear reproduced image of high quality regardless of the variation in environmental conditions at the time of image reproduction, such as a change to a low temperature and low humidity condition or to a high temperature and high humidity condition.

Still another object of this invention is to provide a CPC electrophotographic photoreceptor having excellent electrostatic characteristics and small effects due to the environment.

A further object of this invention is to provide a lithographic printing plate precursor which provides a lithographic printing plate where no background stains occur.

A still further object of this invention is to provide an electrophotographic photoreceptor which is hardly influenced by the kind of sensitizing dyes used in combination.

Yet a further object of this invention is to provide an electrophotographic photoreceptor which can be effectively employed in a scanning exposure system utilizing a semiconductor laser beam.

It has now been found that the above objects of this invention are accomplished by an electrophotographic photoreceptor comprising a support having thereon at least one photoconductive layer containing at least an inorganic photoconductive material and a binder resin, wherein the binder resin contains (A) at least one resin having a weight average molecular weight of from $1\times10^3$ to $3\times10^4$ with at least one substituent selected from the group consisting of

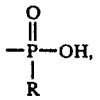

wherein R represents a hydrocarbon group having from 1 to 10 carbon atoms or —OR', wherein R' represents a hydrocarbon group having from 1 to 10 carbon atoms, and a cyclic acid anhydride-containing group, being binded to one or both of the terminals of the main chain thereof, and (B) at least one resin having a weight average molecular weight of $5\times10^4$ or more and containing, as a polymerization component, at least a repeating unit represented by formula (b-i):

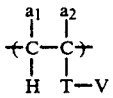

(b-i)

wherein T represents —COO—, —OCO—, —CH OCO—, —$CH_2$COO—, —O— or —$SO_2$—; V represents a hydrocarbon group having from 1 to 22 carbon atoms; and $a_1$ and $a_2$, which may be the same or different, each represents a hydrogen atom, a halogen atom, a cyano group, a hydrocarbon group having from 1 to 8 carbon atoms, —COO—Z, or —COO—Z bonded via a hydrocarbon group having from 1 to 8 carbon atoms, wherein Z represents a hydrocarbon group having from 1 to 18 carbon atoms; wherein Resin (B) has a cross-linked structure.

In a preferred embodiment of the present invention, Resin (A) contains, as a polymerization component, not less than 30% by weight of at least one repeating unit represented by formula (a-i) or (a-ii):

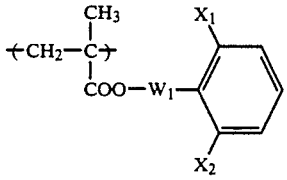

(a-i)

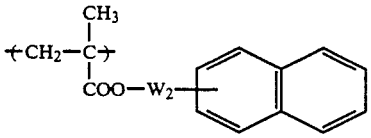

(a-ii)

wherein $X_1$ and $X_2$ each represents a hydrogen atom, a hydrocarbon group having from 1 to 10 carbon atoms, a chlorine atom, a bromine atom, —$COY_1$ or —$COOY_2$, wherein $Y_1$ and $Y_2$ each represents a hydrocarbon group having from 1 to 10 carbon atoms, provided that both $X_1$ and $X_2$ do not simultaneously represent a hydrogen atom; and $W_1$ and $W_2$ each represents a bond or a linking group containing from 1 to 4 linking atoms which connects the —COO— moiety and the benzene ring.

In Resin (A), it is preferable that the above-described specific substituent is bonded to only one of the terminals of the polymer main chain.

In another preferred embodiment of the present invention, Resin (B) has bonded to only one of at least one polymer main chain thereof at least one polar group selected from the group consisting of —$PO_3H_2$, —$SO_3H$, —COOH, —OH, —SH,

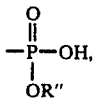

wherein R'' represents a hydrocarbon group, a cyclic acid anhydride-containing group, —CHOP, —$CONH_2$, —$SO_2NH_2$ and

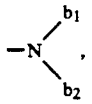

wherein $b_1$ and $b_2$, which may be the same or different, each represents a hydrogen atom or a hydrocarbon group.

It is preferable that Resin (B) does not contain, as a polymerization component, a repeating unit containing the specific substituent which is present in Resin (A).

DETAILED DESCRIPTION OF THE INVENTION

The binder resin according to the present invention comprises at least a low molecular Resin (A) with an acidic group and/or a cyclic acid anhydride-containing group (the cyclic acid anhydride-containing group will hereinafter be considered encompassed by the terminology "acidic group" unless otherwise indicated) being bonded not to the side chain of the main chain thereof but to the terminals of the main chain thereof, and a high molecular Resin (B) at least a part of which is crosslinked. Resin (B) is preferably a resin having a specific polar group bonded to at least one of the terminals of the main chain thereof (hereinafter sometimes referred to as resin (B')), and more preferably a resin containing no acidic group as recited with respect to Resin (A) in the side chain thereof.

It has been confirmed that the acidic groups bonded to the terminal(s) of the polymer main chain of Resin (A) are adsorbed onto stoichiometrical defects of an inorganic photoconductive substance and sufficiently cover the surface thereof, whereby electron traps of the photoconductive substance can be compensated for and humidity resistance can be greatly improved, while assisting sufficiently the dispersion of the photoconductive particles without agglomeration. The fact that Resin (A) has a low molecular weight also functions to improve the covering power for the surface of the photoconductive particles.

Resin (B) functions to increase the mechanical strength of the photoconductive layer, which is insufficient with Resin (A) alone, without impairing the excellent electrophotographic performance achieved by the use of Resin (A).

The photoconductive layer obtained by the present invention has improved surface smoothness. If a photoreceptor to be used as a lithographic printing plate precursor is prepared from a nonuniform dispersion of photoconductive particles in a binder resin with agglomerates being present, the photoconductive layer has a rough surface. As a result, nonimage areas cannot be rendered uniformly hydrophilic by an oil desensitization treatment with an oil-desensitizing solution. This being the case, the resulting printing plate causes the printing ink to adhere to the nonimage areas on printing. This phenomenon leads to background stains in the non-image areas of the prints.

Since binder Resin (B) has a moderately crosslinked structure, and the preferred Resin (B), i.e., resin (B'), has a polar group at only one terminal of the main chain thereof, it is believed that an interaction among the high molecular weight chains and, further, a weak interaction between the polar group and the photoconductive particles synergistically result in a markedly improved film strength consistent with the excellent electrophotographic characteristics achieved.

On the other hand, if Resin (B) contains the same acidic group as that in Resin (A), there is a tendency for the dispersion of the photoconductive substance to be destroyed resulting in the formation of agglomerates or precipitates. Even if a coating film might be formed, considerable deterioration of the electrostatic characteristics of the resulting photoconductive layer occurs, or the photoreceptor tends to have a rough surface and thereby film strength in relation to mechanical abrasion deteriorates.

Even in using low molecular weight Resin (A) of the present invention alone as a sole binder resin, the binder is sufficiently adsorbed onto the photoconductive particles to cover the surface of the particles to thereby provide a smooth photoconductive layer, satisfactory electrostatic characteristics, and stain-free images. The film strength of the resulting photoreceptor, however, is still insufficient for printing durability.

Hence, only if binder resins (A) and (B) are combined, are the adsorption/covering interactions between the inorganic photoconductive substance and the binder resin exerted properly and sufficient film strength is retained.

Resin (A), which is used in the present invention as a binder, has a weight average molecular weight of from $1\times10^3$ to $3\times10^4$, preferably from $3\times10^3$ to $1\times10^4$. The content of the specific acidic group bonded to the terminal(s) of the polymer main chain ranges from 0.5 to 15% by weight, preferably from 1 to 10% by weight. Resin (A) preferably has a glass transition point (Tg) of from −10° C. to 100° C., more preferably from −5° C. to 80° C.

If the molecular weight of Resin (A) is less than $1\times10^3$, the film-forming properties of the binder are reduced, with sufficient film strength not being retained. On the other hand, if it exceeds $3\times10^4$, the electrophotographic characteristics, and particularly the initial potential and dark decay retention, are deteriorated. Deterioration of electrophotographic characteristics is particularly conspicuous in using such a high molecular weight polymer with the acidic group content exceeding 3%, resulting in considerable background staining in application as an offset master.

If the terminal acidic group content in Resin (A) is less than 0.5% by weight, the initial potential is too low to obtain sufficient image density. If it exceeds 15% by weight, dispersibility is reduced, film smoothness and humidity resistance are reduced, and background stains are increased when the photoreceptor is used as an offset master.

Resin (A) preferably contains at least 30% by weight, more preferably from 50 to 97% by weight, of one or more of repeating units represented by formula (a-i) or (a-ii) as a polymerization of copolymerization component (hereinafter sometimes referred to as (a-i)), with the specific acidic group being bonded to the terminal(s) of the main chain thereof.

In formula (a-i), $X_1$ and $X_2$ each preferably represents a hydrogen atom, a chlorine atom, a bromine atom, an alkyl group having up to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chlorophenyl, and dichlorophenyl), or —$COY_1$ or —$COOY_2$, wherein $Y_1$ and $Y_2$ each preferably represents any of the above-recited hydrocarbon groups, provided that $X_1$ and $X_2$ do not simultaneously represent a hydrogen atom.

$W_1$ represents a bond or a linking group containing 1 to 4 linking atoms which connects the —COO—moiety and the benzene ring, e.g., $CH_{2n}$ (n:1, 2 or 3), $+CH_2CH_2OCO+$, $CH_2O_m$ (m: 1 or 2), and $+CH_2CH_2O+$.

In formula (a-ii), $W_2$ has the same meaning as $W_1$ of formula (a-i).

Specific examples of repeating units represented by formula (a-i) or (a-ii) are shown below.

(a-i-1)

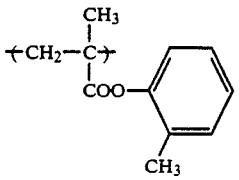

(a-i-2)

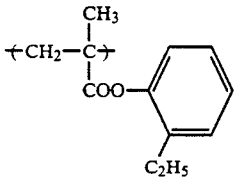

(a-i-3)

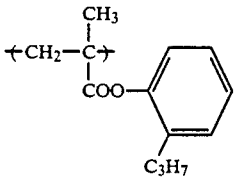

(a-i-4)

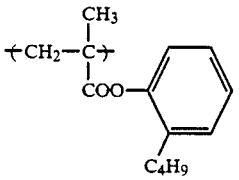

(a-i-5)

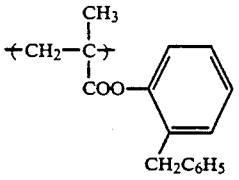

(a-i-6)

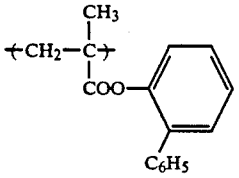

(a-i-7)

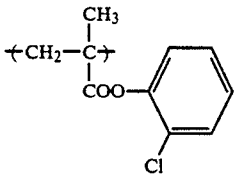

-continued (a-i-8)

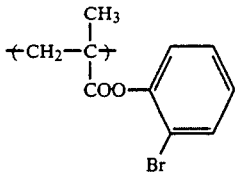

(a-i-9)

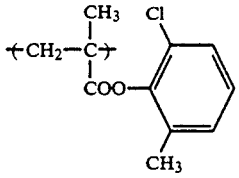

(a-i-10)

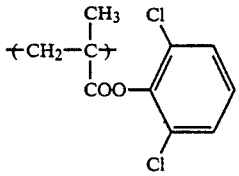

(a-i-11)

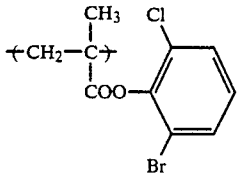

(a-i-12)

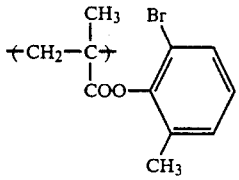

(a-i-13)

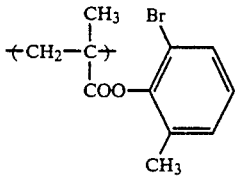

(a-i-14)

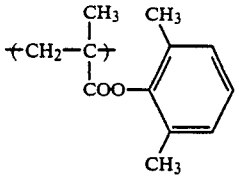

(a-i-15)

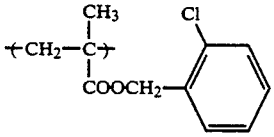

(a-i-16)

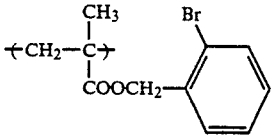

-continued
(a-i-17)
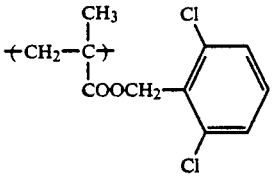
(a-i-18)
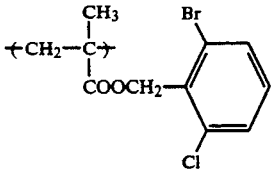
(a-i-19)
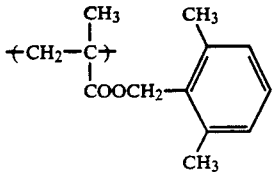
(a-i-20)
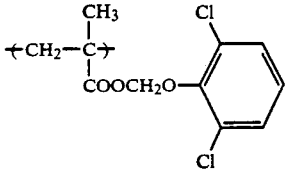
(a-i-21)
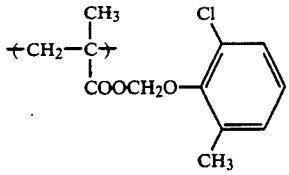
(a-i-22)
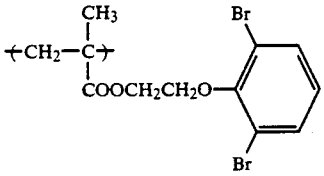
(a-i-23)
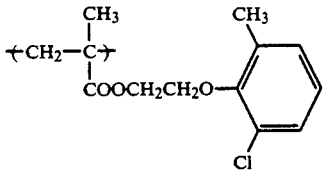
(a-i-24)
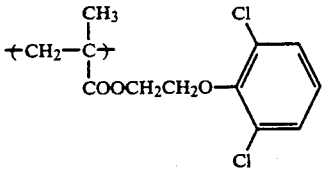
(a-i-25)
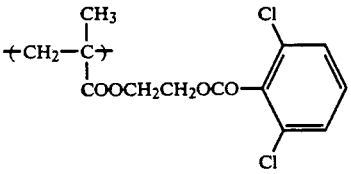
-continued
(a-i-26)
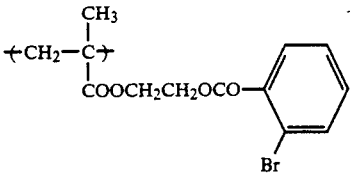
(a-i-27)
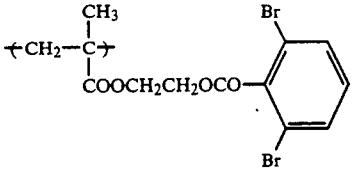
(a-i-28)
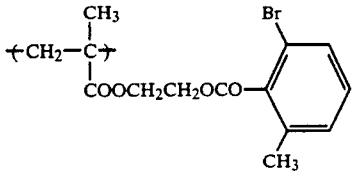
(a-i-29)
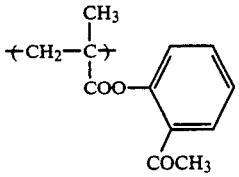
(a-i-30)
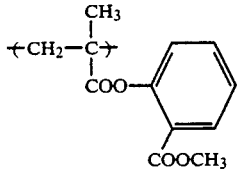
(a-i-31)
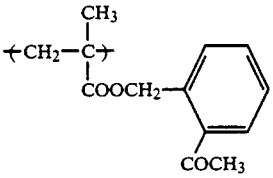
(a-i-32)
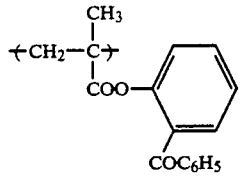
(a-i-33)
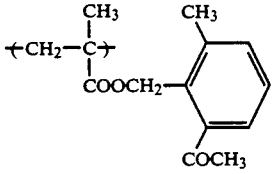
(a-i-34)
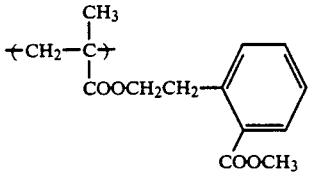

-continued (a-ii-1)

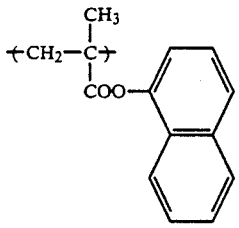

(a-ii-2)

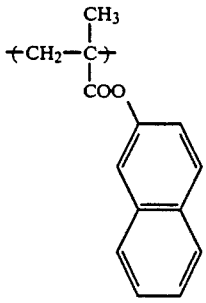

(a-ii-3)

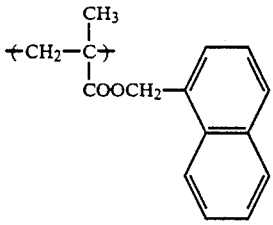

(a-ii-4)

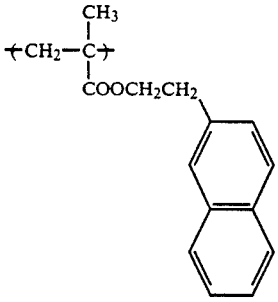

(a-ii-5)

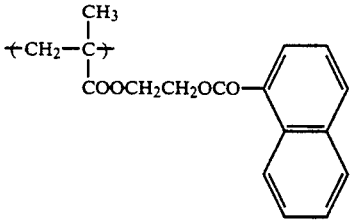

(a-ii-6)

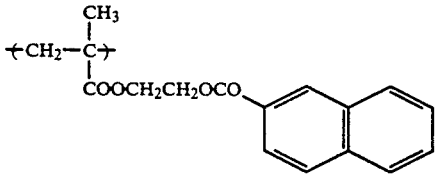

The acidic group bonded to the terminals of the polymer main chain in Resin (A) preferably includes $-PO_3H_2$, $-SO_3H$, $-COOH$,

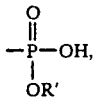

and a cyclic acid anhydride-containing group.

In the group

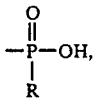

R represents a hydrocarbon group or —OR′, wherein R′ represents a hydrocarbon group. The hydrocarbon group represented by R or R′ preferably includes an aliphatic group having from 1 to 22 carbon atoms (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyle, cyclohexyl, benzyl, phenethyl, 3-phenylpropyl, methylbenzyl, chlorobenzyl, fluorobenzyl, methoxybenzyl) and a substituted or unsubstituted aryl group (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, butoxyphenyl).

The cyclic acid anhydride-containing group is a group containing at least one cyclic acid anhydride. The cyclic acid anhydride present includes aliphatic dicarboxylic acid anhydrides and aromatic dicarboxylic acid anhydrides.

Specific examples of suitable aliphatic dicarboxylic acid anhydrides include a succinic anhydride ring, a glutaconic anhydride ring, a maleic anhydride ring, a cyclopentane-1,2-dicarboxylic acid anhydride ring, a cyclohexane-1,2-dicarboxylic acid anhydride ring, a cyclohexene-1,2-dicarboxylic acid anhydride ring, a 2,3-bicyclo[2,2,2]octanedicarboxylic acid anhydride ring. These rings may be substituted with, for example, a halogen atom (e.g., chlorine, bromine) and an alkyl group (e.g., methyl, ethyl, butyl, hexyl).

Specific examples of aromatic dicarboxylic acid anhydrides are a phthalic anhydride ring, a naphthalenedicarboxylic acid anhydride ring, a pyridinedicarboxylic acid anhydride ring, and a thiophenedicarboxylic acid anhydride ring. These rings may be substituted with, for example, a halogen atom (e.g., chlorine, bromine), an alkyl group (e.g., methyl, ethyl, propyl, butyl), a hydroxyl group, a cyano group, a nitro group, and an alkoxycarbonyl group (e.g., methoxycarbonyl, ethoxycarbonyl).

Resin (A) can be synthesized in such a manner that the specific acidic group may be bonded to the terminals of the main chain of a polymer, preferably a polymer comprising at least one repeating unit of formula (a-i) or (a-ii). In detail, Resin (A) can be prepared by a method using a polymerization initiator containing the specific acidic group or a functional group capable of being converted to the acidic group, a method using a chain transfer agent containing the specific acidic group or a functional group capable of being converted to the acidic group, a method using both of the above-described polymerization initiator and chain transfer agent, and a method of introducing the above-described functional group by taking advantage of termination reaction in anion polymerization. In this connection, reference can be made, e.g., in P. Dreyfuss and R.P. Quirk, *Encyclo. Polym. Sci. Eng.*, No. 7, p. 551 (1987), V. Percec, *Appl. Polym. Sci.*, Vol. 285, p. 95 (1985), P.F. Rempp and E. Franta, *Adv. Polym. Sci.*, Vol. 58, p. 1 (1984), Y. Yamashita, *J. Appl. Polym. Sci. Appl. Polym. Symp.*, Vol. 36, p. 193 (1981), and R. Asami and M. Takaki, *Macromol. Suppl.*, Vol. 12, p. 163 (1985).

Resin (A) may further comprise other copolymerization components in addition to the components of the formula (a-i) or (a-ii). Examples of suitable monomers corresponding to the other copolymerization components include α-olefins, vinyl alkanoates, allyl alkanoates, acrylonitrile, methacrylonitrile, vinyl ethers, acrylic esters, methacrylic esters, acrylamides, methacrylamides, styrenes, and heterocyclic vinyl compounds (e.g., vinylpyrrolidone, vinylpyridine, vinylimidazole, vinylthiophene, vinylimidazoline, vinylpyrazole, vinyldioxane, vinylquinoline, vinylthiazole, vinyloxazine).

Resin (B) used in the present invention is a polymer containing at least one repeating unit represented by formula (b-i) and having a weight average molecular weight of $5\times10^4$ or more, preferably from $8\times10^4$ to $6\times10^5$. Resin (B) preferably has a glass transition point of from 0° C. to 120° C., more preferably from 10° C. to 95° C.

If the weight average molecular weight of Resin (B) is less than $5\times10^4$, the improvement in film strength is insufficient. If it exceeds $6\times10^5$, Resin (B) is substantially not soluble in organic solvents and is of no practical use.

Resin (B) is a polymer or copolymer having the above-described physical properties, which is obtained by homopolymerizing a monomer corresponding to the repeating unit of formula (b-i) or copolymerizing this monomer with other copolymerizable monomer(s), a part of the polymer or copolymer being crosslinked.

In formula (b-i), each of the hydrocarbon groups may have a substituent.

T preferably represents —COO—, —OCO—, —$CH_2$OCO—, —$CH_2$COO—or —O—, more preferably —COO—, —$CH_2$COO—or —O—.

V preferably represents a substituted or unsubstituted hydrocarbon group having from 1 to 18 carbon atoms. The substituent may be any substituent other than the polar group bonded to one terminal of the polymer main chain, including a halogen atom (e.g., fluorine, chlorine, bromine), —O—$V_1$, and —COO—$V_2$, —O-CO—$V_3$, wherein $V_1$, $V_2$ and $V_3$ each represents an alkyl group having from 6 to 22 carbon atoms (e.g., hexyl, octyl, decyl, dodecyl, hexadecyl, octadecyl). A preferred hydrocarbon group for V includes a substituted or unsubstituted alkyl group having from 1 to 18 carbon atoms (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, 3-bromopropyl), a substituted or unsubstituted alkenyl group having from 4 to 18 carbon atoms (e.g., 2-methyl-l-propenyl, 2-butenyl, 2-pentenyl, 3-methyl-2-pentenyl, 1-pentenyl, 1-hexenyl, 2-hexenyl, 4-methyl-2-hexenyl), a substituted or unsubstituted aralkyl group having from 7 to 12 carbon atoms (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl), a substituted or unsubstituted alicyclic group having from 5 to 8 carbon atoms (e.g., cyclohexyl, 2-cyclohexylethyl, 2-cyclopentylethyl), and a substituted or unsubstituted aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, dodecyloylamidophenyl).

$a_1$ and $a_2$, which may be the same or different, each preferably represents a hydrogen atom, a halogen atom (e.g., fluorine, chlorine, bromine), a cyano group, an alkyl group having from 1 to 3 carbon atoms, or —COO—Z or —$CH_2$COO—Z (Z preferably represents an aliphatic group having from 1 to 22 carbon atoms). Each of a and a2 more preferably represents a hydrogen atom, an alkyl group having from 1 to 3 carbon atoms (e.g., methyl, ethyl, propyl), or —COO—Z or —$CH_2$COO—Z, wherein Z more preferably represents an alkyl or alkenyl group having from 1 to 18 carbon atoms (e.g., methyl, ethyl, propyl, butyl, hexyl, octyl, decyl, dodecyl, tridecyl, tetradecyl, hexadecyl, octadecyl, pentenyl, hexenyl, octenyl, decenyl). These alkyl and alkenyl groups may each have a substituent similar to those listed above for V.

In the preparation of Resin (B), introduction of a crosslinked structure into the polymer can be carried out using generally known methods, such as a method in which monomers are polymerized in the presence of a polyfunctional monomer and a method in which a polymer containing a functional group capable of undergoing a crosslinking reaction is subjected to high polymer reaction for crosslinking.

A crosslinking reaction induced by a self-crosslinkable functional group: —$CONHCH_2OR_0$, wherein $R_0$ represents a hydrogen atom or an alkyl group, or a cross-linking reaction induced by polymerization is effective in view of freedom from problems,. such as the reaction takes a long time, the reaction is not quantitative, or impurities originating from, for example, a reaction promotor are present in the final product.

In using a polymerization reactive group, it is preferable that a monomer having two or more polymerizable functional groups is copolymerized with the monomer of the formula (b-i) to thereby form a crosslinked structure across the polymer chains.

Specific examples of polymerizable functional groups include $CH_2{=}CH$—, $CH_2{=}CH{-}CH_2$—,

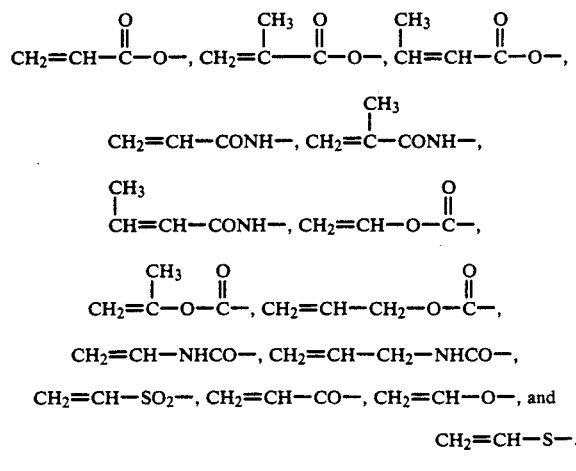

The two or more polymerizable functional groups in the monomer may be the same or different from each other.

Examples of suitable monomers having the same polymerizable functional groups include styrene derivatives (e.g., divinylbenzene and trivinylbenzene); methacrylic, acrylic or crotonic esters, vinyl ethers or allyl ethers of polyhydric alcohols (e.g., ethylene glycol, diethylene glycol, triethylene glycol, polyethylene glycol #200, #400 or #600, 1,3-butylene glycol, neopentyl glycol, dipropylene glycol, polypropylene glycol, trimethylolpropane, trimethylolethane, and pentaerythritol) or polyhydroxyphenols (e.g., hydroguinone, resorcin, catechol and their derivatives); vinyl esters, allyl esters, vinylamides or allylamides of dibasic acids (e.g., malonic acid, succinic acid, glutaric acid, adipic acid, pimelic acid, maleic acid, phthalic acid, and itaconic acid); and condensation products of polyamines (e.g., ethylenediamine, 1,3-propylenediamine, and 1,4butylenediamine) and vinyl-containing carboxylic acids (e.g., methacrylic acid, acrylic acid, crotonic acid, and allylacetic acid).

Examples of monomers having different polymerizable functional groups include vinyl-containing ester derivatives or amide derivatives of vinyl-containing carboxylic acids (such as methacrylic acid, acrylic acid, methacryloylacetic acid, acryloylacetic acid, methacryloylpropionic acid, acryloylpropionic acid, itaconyloylacetic acid, itaconyloylpropionic acid, and a reaction product of a carboxylic acid anhydride and an alcohol or an amine (e.g., allyloxycarbonylpropionic acid, allyloxycarbonylacetic acid, 2-allyloxycarbonylbenzoic acid, and allylaminocarbonylpropionic acid)) (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allylmethacrylamide, N-allylitaconamide, and methacryloylpropionic acid allylamide); and condensation products of amino alcohols (e.g., aminoethanol, 1-aminopropanol, 1aminobutanol, 1-aminohexanol, and 2-aminobutanol) and vinyl-containing carboxylic acids.

Resin (B) having a partially crosslinked structure can be obtained by using the above-described monomer having at least two polymerizable functional groups in a proportion of not more than 20% by weight of the total monomers. The crosslinking density is preferably from 1 to 80%, more preferably from 5 to 50%. Where a polar group is introduced into the terminal of the main chain using a chain transfer agent as hereinafter described, the proportion of the monomer having at least two polymerizable functional groups is preferably not more than 15% by weight of the total monomers. In other cases, the proportion of this monomer is preferably not more than 5% by weight.

When Resin (B) contains no terminal polar group (i.e., when it is not resin (B')), a crosslinked structure may be introduced into the resin using a copolymerization component containing a crosslinking functional group capable of undergoing a curing reaction on heating and/or exposure to light.

This crosslinking functional group is not limited as long as it induces a chemical reaction among molecules to form a chemical bond. That is, any reaction mode in which intramolecular bonding through a condensation reaction, an addition reaction, etc., is suitable or a crosslinking through a polymerization reaction, which can be induced by heat and/or light, can be used. More specifically, the copolymerization component which undergoes a crosslinking reaction upon heating and/or exposure to light includes those having at least one combination of (1) a functional group containing a dissociative hydrogen atom such as —COOH, —$PO_3H_2$,

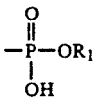

(wherein $R_1$ represents an alkyl group having from 1 to 18, preferably from 1 to 6, carbon atoms (e.g., methyl, ethyl, propyl, butyl and hexyl), an aralkyl group having from 7 to 11 carbon atoms (e.g. benzyl, phenethyl, methylbenzyl, chlorobenzyl and methoxybenzyl), an aryl group having from 6 to 12 carbon atoms (e.g., phenyl, tolyl, xylyl, mesitylene, chlorophenyl, ethylphenyl, methoxyphenyl and naphthyl), or —OR2 (wherein $R_2$ has the same meaning as the above-described hydrocarbon groups for $R_1$)), —OH, —SH, and —NH—R3 (wherein $R_3$ represents a hydrogen atom or an alkyl group having from 1 to 4 carbon atoms (e.g., methyl, ethyl, propyl and butyl)) and (2) a functional group selected from the group consisting of

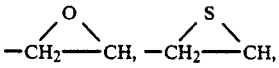

—NCO and —NCS; those including —$CONHCH_2OR_4$ (wherein $R_4$ represents a hydrogen atom or an alkyl group having from 1 to 6 carbon atoms, e.g., methyl, ethyl, propyl, butyl and hexyl); and those including a polymerizable double bond-containing group, etc.

Specific examples of polymerizable double bond-containing groups are those listed as examples for the above-described polymerizable functional groups.

In addition, functional groups and functional group-containing compounds described in the following literature can also be used: Tsuyoshi Endo, *Netsukokasei Kobunshi no Seimitsuka,* C.M.C. (1986), Yuji Harasaki, *Saishin Binder Gijutsu Binran,* Ch. II-1, Sogo Gijutsu Center (1985), Takayuki Ohtsu, *Acryl Jushi no Gosei Sekkei to Shin-yoto Kaihatsu,* Chubu Keiei Kaihatsu Center Shuppanbu (1985), Eizo Ohmori, *Kinosei Acryl Jushi,* Techno System (1985), Hideo Inui and Gentaro Nagamatsu, *Kankosei Kobunshi,* Kodansha (1977), Takahiro Tsunoda, *Shin Kankosei Jushi,* Insatsu Gakkai Shuppanbu (1981), G.E. Green and B.P. Star R, *J. Macro. Sci. Revs. Macro. Chem.,* C21 (2), pp. 187-273 (1981-1982), and C.G. Roffey, *Photopolymerization of Surface Coatings,* A. Wiley Interscience Pub. (1982).

These crosslinking functional groups may be present in a single copolymerization component or in different copolymerization components.

Examples of monomers corresponding to the copolymerization component containing the above-described crosslinking functional group include, for example, vinyl compounds containing a functional group which are copolymerizable with the monomer of formula (b-i). Such vinyl compounds are described, e.g., in *Kobunshi Data Handbook (Kisohen),* High Molecular Society (ed.), Baifukan (1986). Specific examples of these vinyl compounds include acrylic acid, α- and/or β-substituted acrylic acids (e.g., α-acetoxyacrylic acid, α-acetoxymethylacrylic acid, α-(2-aminomethyl)acrylic acid, αchloroacrylic acid, α-bromoacrylic acid, α-fluoroacrylic acid, α-tributylsilylacrylic acid, α-cyanoacrylic acid, β-chloroacrylic acid, β-bromoacrylic acid, α-chloro-βmethoxyacrylic acid, and α,β-dichloroacrylic acid), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, vinyl or allyl half esters of dicarboxylic acids, and ester or amide derivatives of these carboxylic acids or sulfonic acids having the aforesaid crosslinking functional group in the substituent thereof.

It is preferable that the proportion of the copolymerization component containing the crosslinking functional group in Resin (B) is from 1 to 80% by weight, more preferably from 5 to 50% by weight.

In the preparation of Resin (B) containing a crosslinking functional group, a reaction accelerator for accelerating the crosslinking reaction may be used, if desired. Examples of suitable reaction accelerators include acids (e.g., acetic acid, propionic acid, butyric acid, benzenesulfonic acid, and p-toluenesulfonic acid), peroxides, azobis compounds, crosslinking agents, sensitizing agents, and photopolymerrizable monomers. More specifically, crosslinking agents described, e.g., in Shinzo Yamashita and Tosuke Kaneko (ed.), *Kakyozai Handbook*, Taiseisha (1981) can be used. For example, commonly employed crosslinking agents such as organosilanes, polyurethane, and polyisocyanate; and curing agents such as epoxy resins and melamine resins can be used.

Where Resin (B) contains a light-crosslinkable functional group, the compounds described in the references cited above with respect to photosensitive resins can be used.

In addition to the monomers corresponding to the repeating unit of formula (b-i) and the aforesaid polyfunctional monomers, Resin (B) may further contain other monomers (e.g., those recited as comonomers which may be used in Resin (A)) as copolymerization components.

While Resin (B) is characterized as having at least a partial crosslinked structure as stated above, it must also be soluble in organic solvents used for preparation of a dispersion for forming a photoconductive layer. In more detail, Resin (B) should have a solubility of at least 5 parts by weight in 100 parts by weight of, e.g., a toluene solvent at 25° C. Suitable solvents as above referred to include halogenated hydrocarbons, e.g., dichloromethane, dichloroethane, chloroform, methylchloroform and trichlene; alcohols, e.g., methanol, ethanol, propanol and butanol; ketones, e.g., acetone, methyl ethyl ketone and cyclohexanone; ethers, e.g., tetrahydrofuran and dioxane; esters, e.g., methyl acetate, ethyl acetate, propyl acetate, butyl acetate and methyl propionate; glycol ethers, e.g., ethylene glycol monomethyl ether and 2-methoxyethyl acetate; and aromatic hydrocarbons, e.g., benzene, toluene, xylene and chlorobenzene. These solvents may be used either individually or as a combination thereof.

Of the above-described Resins (B), preferred are Resins (B') in which at least one polar group selected from the group consisting of $-PO_3H_2$, $-SO_3H$, $-COOH$, $-OH$, $-SH$,

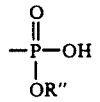

(wherein R'' represents a hydrocarbon group, more specifically R'' has the same meaning as R), a cyclic acid anhydride-containing group (i.e., having the same meaning as described with respect to Resin (A)), $-CHO$, $-CONH_2$, $-SO_2NHY_2$, and

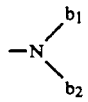

(wherein $b_1$ and $b_2$, which may be the same or different, each represents a hydrogen atom or a hydrocarbon group) is bonded to only one of the terminals of at least one main chain thereof, with this polymer having a weight average molecular weight of not less than $5\times10^4$, preferably from $8\times10^4$ to $6\times10^5$.

Resin (B') preferably has a Tg of from 0° C. to 120° C., more preferably from 10° C. to 95° C.

Examples of hydrocarbon groups represented by $b_1$ or $b_2$ in the polar group

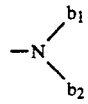

include a substituted or unsubstituted aliphatic group having from 1 to 10 carbon atoms (e.g., methyl, ethyl, propyl, butyl, hexyl, octyl, 2-cyanoethyl, 2-chloroethyl, 2-ethoxycarbonylethyl , benzyl, phenethyl and chlorobenzyl) and a substituted or unsubstituted aryl group (e.g., phenyl, tolyl, xylyl, chlorophenyl, bromophenyl, methoxycarbonylphenyl and cyanophenyl).

Preferred terminal polar groups in Resin (B') are $-PO_3H_2$, $-COOH$, $-SO_3H$, $-OH$, $-SH$,

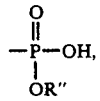

$-CONH_2$ and $-SO_2NH_2$ .

The above-specified polar group may be bonded to one of the polymer main chain terminals either directly or via an arbitrary linking group.

The linking group for connecting the polar group to the polymer main chain terminal is selected from a carbon-carbon bond (single bond or double bond), a carbon-hetero atom bond (where the hetero atom can be an oxygen atom, a sulfur atom, a nitrogen atom, a silicon atom, etc.), a hetero atom-hetero atom bond, and an arbitrary combination thereof. Examples of suitable linking groups are

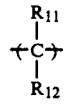

(wherein $R_{11}$ and $R_{12}$ each represents a hydrogen atom, a halogen atom (e.g., fluorine, chlorine and bromine), a cyano group, a hydroxyl group, an alkyl group (e.g., methyl, ethyl, and propyl), etc.),

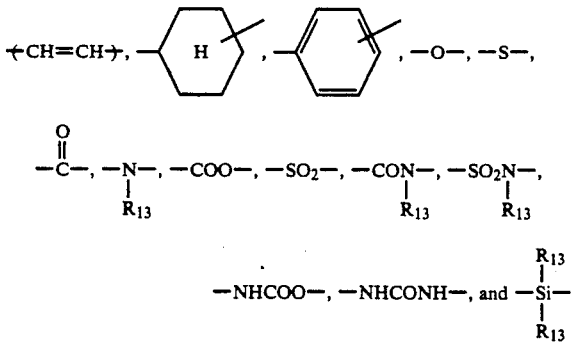

(wherein $R_{13}$ represents a hydrogen atom, a hydrocarbon group having from 1 to 8 carbon atoms (e.g., methyl, ethyl, propyl, butyl, pentyl, hexyl, benzyl, phenethyl, phenyl and tolyl), or $—OR_{14}$ (wherein $R_{14}$ has the same meaning as the hydrocarbon groups recited for $R_{13}$)).

Resin (B') according to the present invention, in which a specific polar group is bonded to only one terminal of at least one main polymer chain thereof, can easily be prepared by an ion polymerization process in which a various kind of a reagent is reacted to the terminal of a living polymer obtained by conventionally known anion polymerization or cation polymerization; a radical polymerization process, in which radical polymerization is performed in the presence of a polymerization initiator and/or a chain transfer agent each of which contains a specific polar group in the molecule thereof; or a process in which a polymer having a reactive group at the terminal as obtained by the above-described ion polymerization or radical polymerization is subjected to high polymer reaction to convert the terminal group to a specific polar group.

For the details of these processes reference can be made to P. Dreyfuss and R.P. Quirk, *Encycl. Polym. Sci. Eng.*, Vol. 7, p. 551 (1987), Yoshiki Nakajo and Yuya Yamashita, *Senryo to Yakuhin*, Vol. 30, p. 232 (1985), Akira Ueda and Susumu Nagai, *Kagaku to Kogyo*, Vol. 60, p. 57 (1986), and the literature cited therein.

In more detail, Resin (B') can be prepared by a method in which a mixture comprising a monomer corresponding to the repeating unit of formula (b-i), the above-described polyfunctional monomer for forming a crosslinked structure, and a chain transfer agent containing a polar group to be bonded to one terminal is polymerized in the presence of a polymerization initiator (e.g., azobis compounds and peroxides), a method in which polymerization of these monomers is conducted by using a polymerization initiator containing the polar group instead of the chain transfer agent, a method in which polymerization is conducted using both of the above-described chain transfer agent and polymerization initiator, a method according to any of the above-described three methods, in which polymerization is conducted using a compound having an amino group, a halogen atom, an epoxy group, an acid halide group, etc., as a chain transfer agent or a polymerization initiator, followed by a high polymer reaction between such a functional group and the polar group to introduce the polar group, and the like. The chain transfer agent to be used includes mercapto compounds containing the polar group or a substituent capable of being converted to the polar group (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenyl-2-mercaptoethylamine, 2-mercaptoimidazole, and 2-mercapto-3-pyridinol) and alkyl iodide compounds containing the polar group or the polar group forming substituent (e.g., iodoacetic acid, iodopropionic acid, 2-iodoethanol, 2-iodoethanesulfonic acid, and 3-iodopropanesulfonic acid). Preferred of them are the mercapto compounds.

The chain transfer agent or polymerization initiator is usually employed in an amount of from 0.5 to 15 parts by weight, preferably from 1 to 10 parts by weight, per 100 parts by weight of the total monomers.

In addition to Resins (A) and (B) (including Resin (B')), the resin binder may further comprise other resins, such as alkyd resins, polybutyral resins, polyolefins, ethylene-vinyl acetate copolymers, styrene resins, ethylene-butadiene copolymers, acrylate-butadiene copolymers, and vinyl alkanoate resins.

The proportion of these conventional resins should not exceed 30% by weight based on the total binder. Should it be more than 30%, the effects of the present invention, particularly improvement in electrostatic characteristics, are lost.

The ratio of Resin (A) to Resin (B) can vary depending on the kind of, particle size of, and surface conditions of the inorganic photoconductive material used. In general, the weight ratio of Resin (A) to Resin (B) is 5 to 80:95 to 20, preferably 15 to 60:85 to 40.

Examples of inorganic photoconductive materials which can be used in the present invention include zinc oxide, titanium oxide, zinc sulfide, cadmium sulfide, cadmium carbonate, zinc selenide, cadmium selenide, tellurium selenide, and lead sulfide.

The resin binder is used in a total amount of from 10 to 100 parts by weight, preferably from 15 to 50 parts by weight, per 100 parts by weight of the inorganic photoconductive material.

If desired, the photoconductive layer may further contain various dyes as spectral sensitizers, such as carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, styryl dyes), and phthalocyanine dyes inclusive of metal-phthalocyanine dyes, as described, e.g., in Harumi Miyamoto and Hidehiko Takei, *Imaging*, Vol. 1973, No. 8, p. 12, C.J. Young, et al., *RCA Review*, Vol. 15, p. 469 (1954), Kohei Kiyota, et al., *Denki Tsushin Gakkai Ronbunshi J 6-C*, No. 2, p. 97 (1980), Yuji Harasaki, et al., *Kogyo Kagaku Zasshi*, Vol. 66, pp. 78 and 188 (1963), and Tadaaki Tani, *Nippon Shashin Gakkaishi*, Vol. 35, p. 208 (1972).

More specifically, suitable carbonium dyes, triphenylmethane dyes, xanthene dyes and phthalein dyes are described in JP-B-51-452, JP-A-50-90334, JP-A-50-114227, JP-A-53-39130, JP-A-53-82353, U.S. Pat. Nos. 3,052,540 and 4,054,450 and JP-A-57-16456. Suitable polymethine dyes, e.g., oxonol dyes, merocyanine dyes, cyanine dyes and rhodacyanine dyes are described in F.M. Harmmer, *The Cyanine Dyes and Related Compounds.* Specific examples of these polymethine dyes are described in U.S. Pat. Nos. 3,047,384, 3,110,591, 3,121,008, 3,125,447, 3,128,179, 3,132,942 and 3,622,317, British Patents 1,226,892, 1,309,274 and 1,405,898, and JP-B-48-7814 and JP-B-55-18892. Suitable polymethine dyes which can be used and which spectrally sensitize in the near infrared to infrared regions of wavelengths longer than 700 nm are described in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure,* 216, pp. 117–118 (1982).

The photoconductive layer of the present invention has excellent performance properties which do not tend to vary depending on the kind of sensitizing dyes used in combination.

The photoconductive layer may additionally contain various conventional additives used in electrophotographic photosensitive layers such as chemical sensitizers. Examples of suitable additives include electron accepting compounds (e.g., halogen, benzoquinone, cloranil, acid anhydrides, organic carboxylic acids) as described in *Imaging,* No. 8. p. 12 (1973), and polyarylalkane compounds, hindered phenol compounds, and p-phenylenediamine compounds as described in Hiroshi Komon, et al., *Saikin no Kododen Zairyo to Kankotai no Kaihatsu Jitsuyoka,* Chs. 4–6, Nippon Kagaku Joho Shuppanbu (1986). The amount of these additives is not particularly limited, but usually ranges from 0.0001 to 2.0 parts by weight per 100 parts by weight of the photoconductive material.

The photoconductive layer can be provided on any known support, and the support usually has a thickness of from 1 to 100 μm, preferably from 10 to 50 μm.

When the present invention is applied to a laminate type photoreceptor composed of a charge generating layer and a charge transport layer, the photoconductive layer functions as the charge generating layer and it has a thickness of from 0.01 to 1 μm, preferably from 0.05 to 0.5 μm.

If desired, an insulating layer can be provided on the photoconductive layer for the prime purposes of protection of the photoreceptor and to improve durability and dark decay characteristics. In this case, the insulating layer is coated in a relatively small thickness. For use in a specific electrophotographic processing, the insulating layer is coated in a relatively large thickness. In the latter case, the insulating layer usually has a thickness of from 5 to 70 μm, preferably from 10 to 50 μm.

Materials for the charge transport layer in the above-described laminate type photoreceptor include polyvinylcarbazole, oxazole dyes, pyrazoline dyes, and triphenylmethane dyes. The charge transport layer usually has a thickness of from 5 to 40 μm, preferably from 10 to 30 μm.

The resin which can be used for formation of the insulating layer or charge transport layer typically includes thermoplastic resins and curable resins, such as polystyrene resins, polyester resins, cellulose resins, polyether resins, vinyl chloride resins, vinyl acetate resins, vinyl chloride-vinyl acetate copolymer resins, polyacrylic resins, polyolefin resins, urethane resins, epoxy resins, melamine resins, and silicone resins.

The photoconductive layer is formed on a conventional support. In general, the support for an electrophotographic photosensitive layer is preferably electrically conductive. Any conventionally employed conductive supports may be utilized in this invention. Examples of usable conductive supports include a base material (e.g., a metal sheet, paper, a plastic sheet) rendered electrically conductive by, for example, impregnation with a low resistance material; a base material with its back side (i.e., the side opposite to that having the photosensitive layer thereon) being rendered conductive and further having coated thereon at least one layer for preventing curling, etc.; the above-described supports having further thereon a water-resistant adhesive layer; the above-described supports having further thereon at least one precoat layer; and a paper laminated with a synthetic resin film on which aluminum, etc., is deposited.

Specific examples of suitable electrically conductive supports and materials for imparting electrical conductivity are described in Yukio Sakamoto, *Denshishashin,* Vol. 14, No. 1, pp. 2–11 (1975), Hiroyuki Moriga, *Nyumon Tokushushi no Kagaku,* Kobunshi Kankokai (1975), and M.F. Hoover, *J. Macromol. Sci. Chem.,* A-4 (6), pp. 1327–1417 (1970).

The present invention is illustrated in greater detail by way of the following Synthesis Examples and Examples, but it should be understood that the present invention is not deemed to be limited thereto. In these examples, all the ratios are by weight unless otherwise specified.

SYNTHESIS EXAMPLE A-1

Synthesis of Resin (A)-1

A mixed solution of 95 g of ethyl methacrylate and 200 g of toluene was heated to 90° C. under a nitrogen stream, and 5 g of 4,4'-azobis(4-cyanovaleric acid) (hereinafter "ABCV") was added thereto, followed by allowing the mixture to react for 10 hours. The resulting copolymer was designated as Resin (A)-1. Resin (A)-1 had a weight average molecular weight (hereinafter referred to as "Mw") of 8,300.

SYNTHESIS EXAMPLE A-2

Synthesis of Resin (A)-2

A mixed solution of 95 g of ethyl methacrylate, 5 g of thioglycolic acid, and 200 g of toluene was heated to 75° C. in a nitrogen stream, and 1.0 g of azobisisobutyronitrile was added thereto, followed by reacting for 8 hours. The resulting Resin (A)-2 had an Mw of 7,800.

SYNTHESIS EXAMPLES A-3 TO A-11

Synthesis of Resins (A)-3 to (A)-11

Resins (A)-3 to (A)-8 shown in Table 1 below were synthesized in the same manner as in Synthesis Example A-2, except for replacing thioglycolic acid with each of the chain transfer agents shown in Table 1 below.

TABLE 1

| Synthesis Example A No. | Resin (A) | Chain Transfer Agent | Mw of Resin (A) |
|---|---|---|---|
| 3 | (A)-3 | $HS(CH_2)_2-COOH$ | 8,300 |
| 4 | (a)-4 | $HS-CH(CH_2-COOH)-COOH$ | 7,600 |
| 5 | (A)-5 | 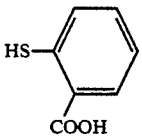 | 7,700 |
| 6 | (A)-6 | $HSCH_2CH_2SO_3H$ | 7,600 |
| 7 | (A)-7 | $HS(CH_2)_3O-P(=O)(OH)-OH$ | 7,800 |
| 8 | (A)-8 | $HS(CH_2)_2O-P(=O)(OC_2H_5)-OH$ | 8,000 |
| 9 | (A)-9 | 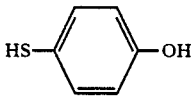 | 7,500 |
| 10 | (A)-10 | 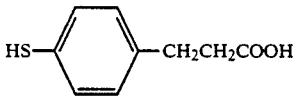 | 8,500 |
| 11 | (A)-11 | 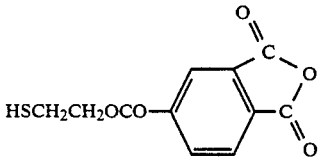 | 8,600 |

SYNTHESIS EXAMPLES A-12 TO A-22

Synthesis of Resins (A)-12 to (A)-22

Resins (A)-12 to (A)-22 shown in Table 2 below were synthesized in the same manner as in Synthesis Example A-1a except for replacing 95 g of ethyl methacrylate with each of the monomers or monomer mixtures shown in Table 2 below. The resulting Resins (A)-12 to (A)-22 had an Mw between 8,000 and 9,000.

TABLE 2

| Synthesis Example A No. | Resin (A) | Monomer (amount) |
|---|---|---|
| 12 | (A)-12 | Propyl methacrylate (95 g) |
| 13 | (A)-13 | Butyl methacrylate (95 g) |
| 14 | (A)-14 | Benzyl methacrylate (95 g) |
| 15 | (A)-15 | Phenethyl methacrylate (95 g) |
| 16 | (A)-16 | Phenyl methacrylate (95 g) |
| 17 | (A)-17 | Methyl methacrylate (80 g)<br>Methyl acrylate (15 g) |
| 18 | (A)-18 | Butyl methacrylate (90 g)<br>Diacetone acrylamide (5 g) |
| 19 | (A)-19 | Ethyl methacrylate (55 g)<br>Methyl methacrylate (40 g) |
| 20 | (A)-20 | Ethyl methacrylate (85 g)<br>2-Methoxyethyl methacrylate (10 g) |

TABLE 2-continued

| Synthesis Example A No. | Resin (A) | Monomer (amount) |
|---|---|---|
| 21 | (A)-21 | Ethyl methacrylate (85 g)<br>Styrene (10 g) |
| 22 | (A)-22 | Benzyl methacrylate (90 g)<br>2-Hydroxyethyl methacrylate (5 g) |

SYNTHESIS EXAMPLE A-23 synthesis of Resin (A) -23

A mixed solution of 95 g of benzyl methacryklate and 200 g of toluene was heated to 95° C. in a nitrogen stream, and 5 g of 2,2'-azobis (4-cyanoheptanol) was added thereto to effect reaction and the reaction was conducted for 8 hours. The temperature was reduced to 85° C., and 1.2 g of succinic anhydride and 1 g of pyridine were added thereto, followed by reaction for an additional 10 hours. The resulting Resin (A)-23 had an Mw of 8,5000.

SYNTHESIS EXAMPLE A-24

Synthesis of Resin (A)-24

A mixed solution of 95 g of 2-chloro-6-methylphenyl methacrylate, 150 g of toluene, and 50 g of isopropanol was heated to 80° C. in a nitrogen stream, and 5 g of ABCV was added thereto, followed by allowing the mixture to react for 10 hours. The resulting Resin (A)-24 had an Mw of 6,500 and a Tg of 40° C.

Structure of Resin (A)-24:

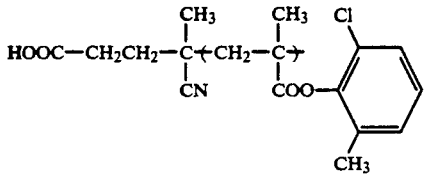

SYNTHESIS EXAMPLES A-25 TO A-46

Synthesis of Resins (A)-25 to (A)-46

Resins (A)-25 to (A)-46 shown in Table 3 below were synthesized in the same manner as in Synthesis Example A-24. The resulting Resins (A)-25 to (A)-46 had an Mw between 6,000 and 8,000.

TABLE 3

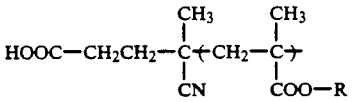

| Synthesis Example A No. | Resin (A) | Ester Substituent R |
|---|---|---|
| 25 | (A)-25 | 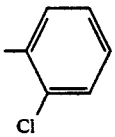 |
| 26 | (A)-26 | 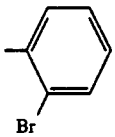 |
| 27 | (A)-27 | 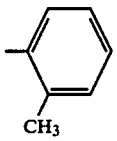 |
| 28 | (A)-28 | 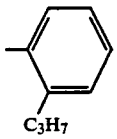 |
| 29 | (A)-29 | 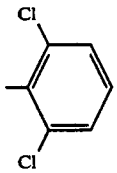 |

TABLE 3-continued

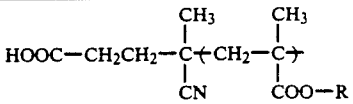

| Synthesis Example A No. | Resin (A) | Ester Substituent R |
|---|---|---|
| 30 | (A)-30 | 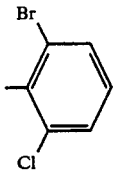 |
| 31 | (A)-31 | 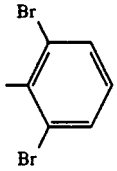 |
| 32 | (A)-32 | 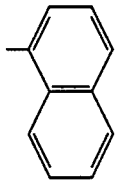 |
| 33 | (A)-33 | 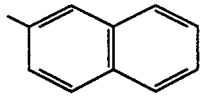 |
| 34 | (A)-34 | 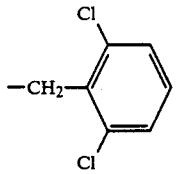 |
| 35 | (A)-35 | 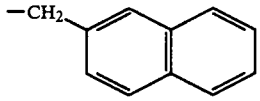 |
| 36 | (A)-36 | 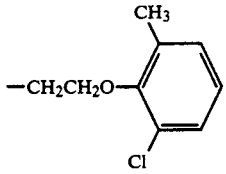 |
| 37 | (A)-37 | 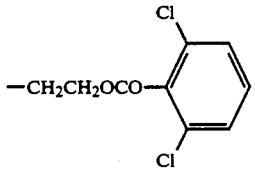 |
| 38 | (A)-38 | 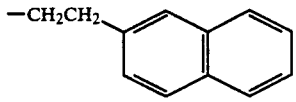 |

TABLE 3-continued

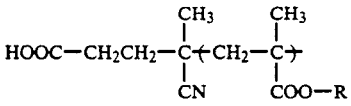

| Synthesis Example A No. | Resin (A) | Ester Substituent R |
|---|---|---|
| 39 | (A)-39 | $-CH_2CH_2O$ 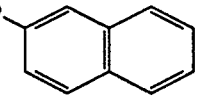 |
| 40 | (A)-40 | 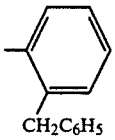 $CH_2C_6H_5$ |
| 41 | (A)-41 | 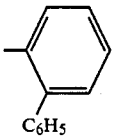 $C_6H_5$ |
| 42 | (A)-42 | 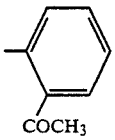 $COCH_3$ |
| 43 | (A)-43 | $-CH_2-$ 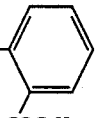 $COC_6H_5$ |
| 44 | (A)-44 | 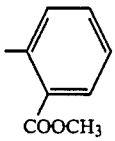 $COOCH_3$ |

TABLE 3-continued

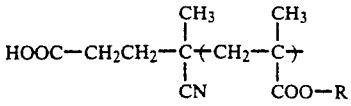

| Synthesis Example A No. | Resin (A) | Ester Substituent R |
|---|---|---|
| 45 | (A)-45 | $-CH_2-$ 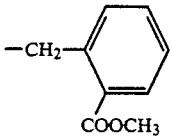 $COOCH_3$ |
| 46 | (A)-46 | $CH_3$ 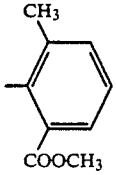 $COOCH_3$ |

SYNTHESIS EXAMPLE A-47

Synthesis of Resin (A)-47

A mixed solutionof 97 g of 2,6-dichlorophenyl methacrylate, 3 g of thioglycolic acid, 150 of toluene, and 50 g of isopropanol was heated to 65° C. in a nitrogen stream, and 0.8 g of azobisisobutyronitrile was added thereto to effect reaction for 8 hours. The resulting Resin (A)-47 had an Mw of 7,800 and a Tg of 36° C.

Structure of Resin (A)-47:

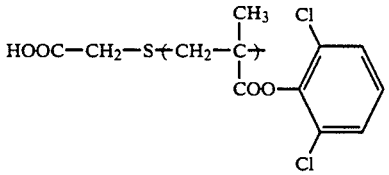

SYNTHESIS EXAMPLES A-48 TO A-53

Synthesis of Resins (A)-48 to (A)-53

Resins (A)-48 to (A)-53 shown in Table 4 below were synthesized in the same manner as in Synthesis Example A-47, except for replacing thioglycolic acid with each of the chain transfer agents shown in Table 4 below.

TABLE 4

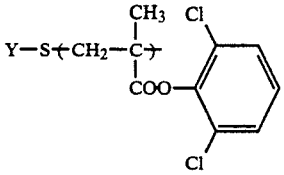

| Synthesis Example A No. | Resin (A) | Y | Chain Transfer Agent | Mw of Resin (A) |
|---|---|---|---|---|
| 48 | (A)-48 | $HOOC(CH_2)_2$ | $HS(CH_2)_2-COOH$ | 8,100 |
| 49 | (A)-49 | $HOOC-CH-$ <br> $HOOC-CH_2$ | $HS-CH-COOH$ <br> $CH_2-COOH$ | 8,500 |

TABLE 4-continued

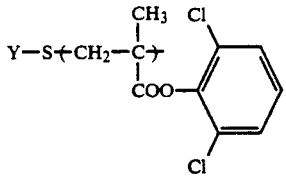

| Synthesis Example A No. | Resin (A) | Y | Chain Transfer Agent | Mw of Resin (A) |
|---|---|---|---|---|
| 50 | (A)-50 | 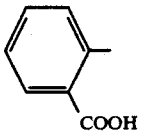 | 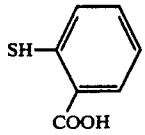 | 7,800 |
| 51 | (A)-51 | $HO_3S\text{-}(CH_2)_2\text{-}$ | $HS\text{-}(CH_2)_2\text{-}SO_3H$ | 8,000 |
| 52 | (A)-52 | $HO\text{-}P(=O)(OH)\text{-}O\text{-}(CH_2)_3\text{-}$ | $HS\text{-}(CH_2)_3\text{-}O\text{-}P(=O)(OH)\text{-}OH$ | 7,500 |
| 53 | (A)-53 | $HO\text{-}P(=O)(OC_2H_5)\text{-}O\text{-}(CH_2)_3\text{-}$ | $HS\text{-}(CH_2)_3\text{-}O\text{-}P(=O)(OC_2H_5)\text{-}OH$ | 7,600 |

SYNTHESIS EXAMPLE B-1

Synthesis of Resin (B)-1

A mixed solution of 100 g of ethyl methacrylate, 1.0 g of ethylene glycol dimethacrylate, and 200 g of toluene was heated to 75° C. in a nitrogen stream, and 1.0 g of azobisisobutyronitrile was added thereto, followed by allowing the mixture to react for 10 hours. The resulting Resin (B)-1 had an Mw of 4.2 x $10^5$.

SYNTHESIS EXAMPLES B-2 TO B-19

Synthesis of Resins (B)-2 to (B)-19

Resins (B)-2 to (B)-19 shown in Table 5 below were synthesized in the same manner as in Synthesis Example B-1, except for using each of the monomers or monomer mixtures and each of the crosslinking monomers or monomer mixtures shown in Table 5 below.

TABLE 5

| Synthesis Example B No. | Resin (B) | Monomer(s) | Crosslinking Monomer(s) | Mw of Resin (B) |
|---|---|---|---|---|
| 2 | (B)-2 | Ethyl methacrylate (100 g) | Propylene glycol dimethacrylate (1.0 g) | 2.4 × $10^5$ |
| 3 | (B)-3 | Butyl methacrylate (100 g) | Diethylene glycol dimethacrylate (0.8 g) | 3.4 × $10^5$ |
| 4 | (B)-4 | Propyl methacrylate (100 g) | Vinyl methacrylate (3 g) | 9.5 × $10^5$ |
| 5 | (B)-5 | Methyl methacrylate (80 g)<br>Ethyl acrylate (20 g) | Divinylbenzene (0.8 g) | 8.8 × $10^5$ |
| 6 | (B)-6 | Ethyl methacrylate (75 g)<br>Methyl acrylate (25 g) | Diethylene glycol diacrylate (0.8 g) | 2.0 × $10^5$ |
| 7 | (B)-7 | Styrene (20 g)<br>Butyl methacrylate (80 g) | Triethylene glycol trimethacrylate (0.5 g) | 3.3 × $10^5$ |
| 8 | (B)-8 | Methyl methacrylate (40 g)<br>Propyl methacrylate (60 g) | IPS-22GA (product of Okamoto Seiyu K.K.) (0.9 g) | 3.6 × $10^5$ |
| 9 | (B)-9 | Benzyl methacrylate (100 g) | Ethylene glycol dimethacrylate (0.8 g) | 2.4 × $10^5$ |
| 10 | (B)-10 | Butyl methacrylate (95 g)<br>2-Hydroxyethyl methacrylate (5 g) | Ethylene glycol dimethacrylate (0.8 g) | 2.0 × $10^5$ |
| 11 | (B)-11 | Ethyl methacrylate (90 g)<br>Acrylonitrile (10 g) | Divinylbenzene (0.7 g) | 1.0 × $10^5$ |
| 12 | (B)-12 | Ethyl methacrylate (99.5 g)<br>Methacrylic acid (0.5 g) | Triethylene glycol dimethacrylate (0.8 g) | 1.5 × $10^5$ |
| 13 | (B)-13 | Butyl methacrylate (70 g)<br>Phenyl methacrylate (30 g) | Diethylene glycol dimethacrylate (1.0 g) | 2.0 × $10^5$ |
| 14 | (B)-14 | Ethyl methacrylate (95 g)<br>Acrylamide (5 g) | Diethylene glycol dimethacrylate (1.0 g) | 2.4 × $10^5$ |
| 15 | (B)-15 | Propyl methacrylate (92 g)<br>N,N-Dimethylaminoethyl methacrylate (8 g) | Divinylbenzene (1.0 g) | 1.8 × $10^5$ |
| 16 | (B)-16 | Ethyl methacrylate (70 g)<br>Methyl crotonate (30 g) | Divinylbenzene (0.8 g) | 1.4 × $10^5$ |

TABLE 5-continued

| Synthesis Example B No. | Resin (B) | Monomer(s) | Crosslinking Monomer(s) | Mw of Resin (B) |
|---|---|---|---|---|
| 17 | (B)-17 | Propyl methacrylate (95 g)<br>Diacetone acrylamide (5 g) | Propylene glycol dimethacrylate (0.8 g) | $1.8 \times 10^5$ |
| 18 | (B)-18 | Ethyl methacrylate (93 g)<br>6-Hydroxyhexamethylene methacrylate (7 g) | Ethylene glycol dimethacrylate (0.8 g) | $2.0 \times 10^5$ |
| 19 | (B)-19 | Ethyl methacrylate (90 g)<br>2-Cyanoethyl methacrylate (10 g) | Ethylene glycol dimethacrylate (0.8 g) | $1.8 \times 10^5$ |

SYNTHESIS EXAMPLE B-20

Synthesis of Resin (B)-20

A mixed solution of 99 g of ethyl methacrylate, 1 g of ethylene glycol dimethacrylate, 150 g of toluene, and 50 g of methanol was heated to 70° C. in a nitrogen stream, and 1.0 g of 4,4'-azobis(4-cyanopentanoic acid) was added thereto to effect reaction for 8 hours. The resulting Resin (B)-20 had an Mw of $1.0 \times 10^5$.

SYNTHESIS EXAMPLES B-21 TO B-24

Synthesis of Resins (B)-21 to (B)-24

Resins (B)-21 to (B)-24 shown in Table 6 below were synthesized in the same manner as in Synthesis Example B-20, except for replacing 4,4'-azobis(4-cyanopentanoic acid) with each of the polymerization initiators shown in Table 6 below. The resulting Resins (B)-21 to (B)-24 had an Mw between $1.0 \times 10^5$ and $3 \times 10^5$.

SYNTHESIS EXAMPLE B-25

Synthesis of Resin (B)-25

A mixed solution of 99 g of ethyl methacrylate, 1.0 g of thioglycolic acid, 2.0 g of divinylbenzene, and g of toluene was heated to 80° C. in a nitrogen stream, and 0.8 g of 2,2'-azobis(cyclohexane-l-carbonitrile) (hereinafter "ACHN") was added thereto to effect reaction for 4 hours. Then, 0.4 g of ACHN was added thereto, followed by reaction for 2 hours. Thereafter, 0.2 g of ACHN was further added, followed by reaction for 2 hours. The resulting Resin (B)-25 had an Mw of $1.2 \times 10^5$.

SYNTHESIS EXAMPLES B-26 TO B-38

Synthesis of Resins (B)-26 to (B)-38

Resins (B)-.26 to (B)-38 shown in Table 7 below were synthesized in the same manner as in Synthesis Example B-25, except for replacing 2.0 g of divinylbenzene, as a crosslinking polyfunctional monomer, with each of the crosslinking monomers or oligomers as shown in Table 7 below.

TABLE 6

| Synthesis Example B No. | Resin (B) | Polymerization Initiator R—N=N—R | R— |
|---|---|---|---|
| 21 | (B)-21 | 2,2'-Azobis(2-cyanopropanol) | $HO-CH_2-C(CH_3)(CN)-$ |
| 22 | (B)-22 | 2,2'-Azobis(2-cyanopentanol) | $HOCH_2CH_2CH_2-C(CH_3)(CN)-$ |
| 23 | (B)-23 | 2,2'-Azobis[2-methyl-N-(2-hydroxyethyl)propionamide] | $HOCH_2CH_2NH-C(=O)-C(CH_3)_2-$ |
| 24 | (B)-24 | 2,2'-Azobis{2-methyl-N-[1,1-bis(hydroxymethyl)-2-hydroxyethyl]propionamide} | $HOH_2C-C(CH_2OH)_2-C(=O)-NH-C(CH_3)_2-$ |

TABLE 7

| Synthesis Example B No. | Resin (B) | Crosslinking Monomer or Oligomer (amount) | Mw of Resin (B) |
|---|---|---|---|
| 26 | (B)-26 | Ethylene glycol dimethacrylate (2.5 g) | $2.2 \times 10^5$ |
| 27 | (B)-27 | Diethylene glycol dimethacrylate (3 g) | $2.0 \times 10^5$ |
| 28 | (B)-28 | Vinyl methacrylate (6 g) | $1.8 \times 10^5$ |
| 29 | (B)-29 | Isopropenyl methacrylate (6 g) | $2.0 \times 10^5$ |

TABLE 7-continued

| Synthesis Example B No. | Resin (B) | Crosslinking Monomer or Oligomer (amount) | Mw of Resin (B) |
|---|---|---|---|
| 30 | (B)-30 | Divinyl adipate (10 g) | $1.0 \times 10^5$ |
| 31 | (B)-31 | Diallyl glutanonate (10 g) | $9.5 \times 10^5$ |
| 32 | (B)-32 | ISP-22GA (product of Okamura Seiyu K.K.) (5 g) | $1.5 \times 10^5$ |
| 33 | (B)-33 | Triethylene glycol diacrylate (2 g) | $2.8 \times 10^5$ |
| 34 | (B)-34 | Trivinylbenzene (0.8 g) | $3.0 \times 10^5$ |
| 35 | (B)-35 | Polyethylene glycol #400 diacrylate (3 g) | $2.5 \times 10^5$ |
| 36 | (B)-36 | Polyethylene glycol dimethacrylate (3 g) | $2.5 \times 10^5$ |
| 37 | (B)-37 | Trimethylolpropane triacrylate (0.5 g) | $1.8 \times 10^5$ |
| 38 | (B)-38 | Polyethylene glycol #600 diacrylate (3 g) | $2.8 \times 10^5$ |

SYNTHESIS EXAMPLES B-39 TO B-49

Synthesis of Resin (B)-39 to (B)-49

A mixed solution of 39 g of methyl methacrylate, 60 g of ethyl methacrylate, 1.0 g of each of the mercapto compounds shown in Table 8 below, 2 g of ethylene glycol dimethacrylate, 150 g of toluenme, and 50 g of methanol was heated to 70° C. in a nitrogen stream, and 0.8 g of 2,2'-azobi(isobutyronitrile) was added to the mixture, followed by reaction for 4 hours. Then, 0.4 g of 2,2'-azobis (isobutyronitrile) was further added thereto, followed by reaction for 4 hours. The resulting Resins (B)-39 to (B)-49 had an Mw between $9.5 \times 10^4$ and $2 \times 10^5$.

TABLE 8

| Synthesis Example B No. | Resin (B) | Mercapto Compound |
|---|---|---|
| 39 | (B)-39 | $CH_2COOH$ \| $HSCHCOOH$ |
| 40 | (B)-40 | 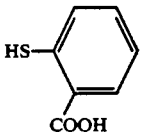 |
| 41 | (B)-41 | $HSCH_2CH_2NH_2$ |
| 42 | (B)-42 | $HSCH_2CH_2O-P(=O)(OH)-OH$ |
| 43 | (B)-43 | $HSCH_2CH_2O-P(=O)(OC_2H_5)-OH$ |

TABLE 8-continued

| Synthesis Example B No. | Resin (B) | Mercapto Compound |
|---|---|---|
| 44 | (B)-44 | 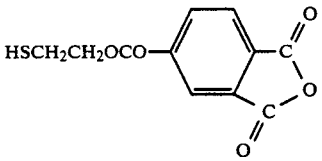 |
| 45 | (B)-45 | $HSCH_2CH_2COOH$ |
| 46 | (B)-46 | 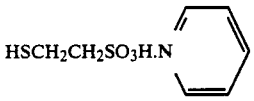 |
| 47 | (B)-47 | $HSCH_2CH_2NHCO(CH_2)_3COOH$ |
| 48 | (B)-48 | $HSCH_2CH_2N(CH_3)_2$ |
| 49 | (B)-49 | $HSCH_2CH_2OH$ |

EXAMPLE 1

A mixture of 6 g (on a solids basis) of Resin (A)-1 as synthesized in Synthesis Example A-1, 34 g (on a solids basis) of Resin (B)-1 as synthesized in Synthesis Example B-1, 200 g of zinc oxide, 0.02 g of a heptamethinecyanine dye (A) shown below, 0.05 g of phthalic anhydride, and 300 g of toluene was dispersed in a ball mill for 2 hours to prepare a photosensitive coating composition. The composition was coated on a paper, rendered electrically conductive, to a dry coverage of 18 g/m$^2$ with a wire bar, followed by drying at 110° C. for 1 minute. The photosensitive layer was then allowed to stand in a dark place at 20° C. and 65% RH (relative humidity) for 24 hours to produce an electrophotographic photoreceptor.

Dye (A):

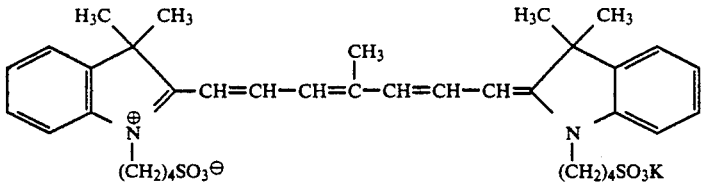

EXAMPLE 2

An electrophotographic photoreceptor was prepared in the same manner as in Example 1, except for replacing 34 g of Resin (B)-1 with 34 g (on a solids basis) of Resin (B)-25.

COMPARATIVE EXAMPLE 1

An electrophotographic photoreceptor was produced in the same manner as in Example 1, except for replacing 6 g of Resin (A)-1 and 34 g of Resin (B)-1 with 40 g of Resin (A)-1 alone. The resulting photoreceptor was designated Sample A.

COMPARATIVE EXAMPLE 2

An electrophotographic photoreceptor (Sample B) was produced in the same manner as in Comparative Example 1, except for using 40 g (on a solids basis) of an ethyl methacrylate/acrylic acid copolymer (95/5 by weight; Mw =7,500) (hereinafter referred to as Resin (R)-1) in place of 40 g of Resin (A)-1.

COMPARATIVE EXAMPLE 3

An electrophotographic photoreceptor (Sample C) was produced in the same manner as in Comparative Example 1, except for using 40 g of an ethyl methacrylate/acrylic acid copolymer (98.5/1.5 by weight; Mw =4,500 (hereinafter referred to as Resin (R)-2) in place of 40 g of Resin (A)-1.

COMPARATIVE EXAMPLE 4

An electrophotographic photoreceptor (Sample D) was produced in the same manner as in Example 1, except for replacing 6 g of Resin (A)-1 with 6 g of Resin (R)-1.

COMPARATIVE EXAMPLE 5

An electrophotographic photoreceptor (Sample E) was produced in the same manner as in Example 2'except for replacing 6 g of Resin (A)-1 with 6 g of Resin (R)-1.

Each of the photoreceptors obtained in Examples 1 and 2 and Comparative Examples 1 to 5 was evaluated as to film properties in terms of surface smoothness and mechanical strength; electrostatic characteristics; image forming performance; oil desensitivity of the photoconductive layer in terms of contact angle with water after oil desensitization; and printing suitability in terms of stain resistance and printing durability in accordance with the following testing methods.

The results obtained are shown in Table 9 below.

(1) Smoothness of Photoconductive Layer:

The smoothness (sec/cc) was measured using a Beck's smoothness tester manufactured by Kumagaya Riko K.K. under an air volume condition of 1 cc.

(2) Mechanical Strenqth of Photoconductive Layer:

The surface of the photoreceptor was repeatedly rubbed with emery paper (#1000) under a load of 50 g/cm$^2$ using a Heidon 14 Model surface testing machine (manufactured by Shinto Kagaku K.K.). After dusting, the abrasion loss of the photoconductive layer was measured to obtain film retention (%).

(3) Electrostatic Characteristics:

The sample was charged with a corona discharge to a voltage of −6 kV for 20 seconds in a dark room at 20° C. and 65% RH using a paper analyzer ("Paper Analyzer SP-428" manufactured by Kawaguchi Denki K.K.). After the lapse of 10 seconds from the end of the corona discharge, the surface potential $V_{10}$ was measured. The sample was allowed to stand in the dark for an additional 90 seconds and the potential $V_{100}$ was measured. The dark decay retention (DRR; %), i.e., percent retention of potential after dark decay for 90 seconds, was calculated from the equation:

$$\text{DRR}\ (\%) = (\%)(V_{100}/V_{10}) \times 100$$

Separately, the sample was charged to −400 V with a corona discharge and then exposed to light emitted by a gallium-aluminum-arsenic semiconductor laser (oscillation wavelength: 830 nm), and the time required for the decay of the surface potential $V_{10}$ to one-tenth of the original value was measured to obtain an exposure $E_{1/10}$ (erg/cm$^2$).

The measurements were conducted under conditions of 20° C. and 65% RH (relative humidity) (hereinafter referred to as "Condition I") or 30° C. and 80% RH (hereinafter referred to as "Condition II").

(4) Image Forming Performance:

After the samples were allowed to stand for one day under Condition I or Condition II, each sample was charged to −6 kV and exposed to light emitted by a galliun-aluminum-arsenic semiconductor laser (oscillation wavelength: 830 nm; output: 2.8 mW) at an exposure amount of 64 erg/cm$^2$ on the surface of the photoconductive layer) at a pitch of 25 μm and a scanning speed of 300 m/sec. The electrostatic latent image was developed with a liquid developer ("ELP-T"produced by Fuji Photo Film Co., Ltd.), followed by fixing. The fog and image quality of the reproduced image were visually evaluated.

(5) Contact Angle with Water:

The sample was passed once through an etching processor using an oil-desensitizing solution ("ELP-E" produced by Fuji Photo Film Co., Ltd.) to render the surface of the photoconductive layer oil-desensitive. A drop of 2 μl of distilled water was placed on the thus oil-desensitized surface, and the contact angle formed between the surface and the water was measured using a goniometer.

(6) Printing Durability:

The sample was processed in the same manner as described in 4) above, and the surface of the photoconductive layer was subjected to oil desensitization under the same conditions as in 5) above. The resulting lithographic printing plate was mounted on an offset printing machine ("Oliver Model 52", manufactured by Sakurai Seisakusho K.K.), and printing was carried out on fine paper. The number of prints obtained until background stains in the nonimage areas appeared or the quality of the image areas was deteriorated was taken as the printing durability. The larger the number of the prints, the higher the printing durability.

Sample A, in which only Resin (A) of the present invention was used as a binder, showed quite satisfactory electrostatic characteristics, but the printed image quality of an offset master plate produced therefrom was deteriorated from the 3,000th print.

Sample B had a decrease in DRR and an increase in $E_{1/10}$.

Further, Sample C using a binder resin having the same chemical structure as that used in Sample B but having an increased weight average molecular weight resulted in serious deterioration of the electrostatic characteristics. This is probably because an increased molecular weight caused not only adsorption onto the photoconductive particles but agglomeration of the particles.

Overall, an electrophotographic photoreceptor satisfying both the requirements of electrostatic characteristics and printing suitability cannot be obtained without use of the binder resin according to the present invention.

TABLE 9

| | Example | | Comparative Example | | | | |
|---|---|---|---|---|---|---|---|
| | 1 | 2 | 1 | 2 | 3 | 4 | 5 |
| Surface Smoothness (sec/cc) | 90 | 90 | 90 | 90 | 35 | 88 | 92 |
| Film Strength (%) | 85 | 93 | 70 | 65 | 65 | 85 | 90 |
| Electrostatic Characteristics: | | | | | | | |
| $V_{1/10}$ (−V): Condition I | 555 | 560 | 560 | 520 | 410 | 525 | 530 |
| Condition II | 545 | 550 | 555 | 480 | 300 | 500 | 505 |
| DRR (%): Condition I | 85 | 86 | 88 | 85 | 65 | 65 | 66 |
| Condition II | 80 | 85 | 84 | 70 | 35 | 30 | 30 |
| $E_{1/10}$ (erg/cm$^2$): | | | | | | | |
| Condition I | 40 | 36 | 35 | 45 | 120 | 45 | 45 |
| Condition II | 42 | 35 | 35 | 50 | 75 | 48 | 46 |
| Image Forming Performance: | | | | | | | |
| Conditon I | Good | Good | Good | Good | Poor (cuts of letters or thin lines) | Good | Good |
| Condition II | Good | Good | Good | No good (reduction of $D_m$) | Very poor (background fog, many streaks) | No good (reduction of $D_m$) | No good (reduction of $D_m$) |
| Contact Angle with Water (°) | 11 | 13 | 10 | 11 | 25–30 (large scatter) | 12 | 12 |
| Printing Durability | 8,000 | 10,000 or more | 3,000 | 3,000 | Background stains from the start of printing | 8,000 | 10,000 or more |

As can be seen from the results in Table 9, each of the photoreceptors according to the present invention exhibited satisfactory surface smoothness, film strength, and electrostatic characteristics. When it was used as an offset master plate precursor, the reproduced image was clear and free from background stains in the nonimage area. These results are attributed to sufficient adsorption of the binder resin onto the photoconductive substance and sufficient covering of the surface of the photoconductive particles with the binder resin. For the same reason, oil desensitization of the offset master plate precursor with an oil-desensitizing solution was sufficient to render the nonimage area sufficiently hydrophilic, as is demonstrated by the small contact angle of 20° or less with water. No background stains were observed in the prints on practical printing using the resulting master plate.

EXAMPLES 3 TO 26

An electrophotographic photoreceptor was produced in the same manner as in Example 1, except for replacing Resin (A)-1 and Resin (B)-1 with each of Resins (A) and each of Resins (B) shown in Table 10 below, respectively.

The electrostatic characteristics as determined under Condition II and printing durability of the resulting photoreceptors were evaluated in the same manner as in Example 1, and the results obtained are also shown in Table 10 below.

TABLE 10

| Example No. | Resin (A) | Resin (B) | $V_{10}$ (−V) | DRR (%) | $E_{1/10}$ (erg/cm$^2$) | Printing Durability |
|---|---|---|---|---|---|---|
| 3 | (A)-4 | (B)-2 | 560 | 83 | 38 | 8,000 |
| 4 | (A)-5 | (B)-2 | 555 | 85 | 37 | 8,000 |
| 5 | (A)-4 | (B)-4 | 560 | 82 | 39 | 8,000 |
| 6 | (A)-6 | (B)-4 | 550 | 82 | 40 | 8,000 |
| 7 | (A)-7 | (B)-5 | 545 | 80 | 42 | 8,500 |
| 8 | (A)-8 | (B)-6 | 555 | 82 | 40 | 8.000 |
| 9 | (A)-9 | (B)-7 | 540 | 85 | 38 | 8,500 |
| 10 | (A)-10 | (B)-7 | 550 | 82 | 40 | 8,500 |

TABLE 10-continued

| Example No. | Resin (A) | Resin (B) | $V_{10}$ (−V) | DRR (%) | $E_{1/10}$ (erg/cm$^2$) | Printing Durability |
|---|---|---|---|---|---|---|
| 11 | (A)-11 | (B)-8 | 555 | 81 | 40 | 8,000 |
| 12 | (A)-12 | (B)-10 | 540 | 83 | 41 | 8,000 |
| 13 | (A)-13 | (B)-11 | 565 | 86 | 37 | 8,500 |
| 14 | (A)-15 | (B)-14 | 550 | 83 | 40 | 8,000 |
| 15 | (A)-16 | (B)-16 | 555 | 83 | 40 | 8,000 |
| 16 | (A)-17 | (B)-10 | 530 | 80 | 38 | 8,000 |
| 17 | (A)-18 | (B)-20 | 550 | 81 | 43 | 8,300 |
| 18 | (A)-19 | (B)-21 | 555 | 82 | 40 | 10,000 or more |
| 19 | (A)-20 | (B)-22 | 540 | 80 | 40 | 10,000 or more |
| 20 | (A)-21 | (B)-23 | 540 | 81 | 39 | 10,000 or more |
| 21 | (A)-22 | (B)-32 | 530 | 80 | 41 | 10,000 or more |
| 22 | (A)-14 | (B)-35 | 565 | 87 | 35 | 10,000 or more |
| 23 | (A)-14 | (B)-39 | 565 | 85 | 35 | 10,000 or more |
| 24 | (A)-14 | (B)-40 | 560 | 84 | 36 | 10,000 or more |
| 25 | (A)-2 | (B)-41 | 555 | 82 | 41 | 10,000 or more |
| 26 | (A)-2 | (B)-44 | 565 | 83 | 42 | 10,000 or more |

It can be seen from the results in Table 10 that each of the photoreceptors according to the present invention exhibits excellent electrostatic characteristics even processed under sever environmental conditions. An offset master plate produced from each of these photoreceptors exhibited satisfactory printability.

EXAMPLES 27 TO 45

A mixture of 6.5 g each of Resins (A) shown in Table 11 below, 33.5 g each of Resins (B) shown in Table below, 200 g of zinc oxide, 0.05 g of Rose Bengale, 0.03 g of Tetrabromophenol Blue, 0.02 g of uranine, 0.01 g of phthalic anhydride, and 240 g of toluene was dispersed in a ball mill for 2 hours. The resulting photoconductive composition was coated on a paper, rendered electrically conductive, with a wire bar to a dry thickness of 18 g/m2 and heated at 110° C. for seconds. Then, the resulting coated material was allowed to stand at 20° C. and 65% RH for 24 hours to obtain an electrophotographic photoreceptor.

The electrostatic characteristics as determined under Condition II and the printing durability of the resulting photoreceptors were evaluated in the same manner as in Example 1, except that photosensitivity ($E_{1/10}$: lux sec) was determined by exposing the photoconductive layer (charged to −400 V) to visible light of 2.0 lux and determining the time required for the surface potential ($V_{10}$) to decrease to one-tenth the initial value and an offset master plate was produced using an automatic plate making machine ("ELP 404V", manufactured by Fuji Photo Film Co., Ltd.) and a toner ("ELPT" produced by Fuji Photo Film Co., Ltd.) to form a toner image. The results obtained are shown in Table 11 below.

TABLE 11

| Example No. | Resin (A) | Resin (B) | $V_{10}$ (-V) | DRR (%) | $E_{1/10}$ (lux · sec) | Printing Durability |
|---|---|---|---|---|---|---|
| 27 | (A)-1 | (B)-2 | 550 | 88 | 6.3 | 8,000 |
| 28 | (A)-2 | (B)-4 | 555 | 89 | 6.0 | " |
| 29 | (A)-3 | (B)-5 | 550 | 89 | 6.0 | " |
| 30 | (A)-4 | (B)-6 | 550 | 88 | 6.4 | " |
| 31 | (A)-5 | (B)-7 | 555 | 89 | 6.0 | 8,500 |
| 32 | (A)-6 | (B)-7 | 545 | 86 | 6.0 | " |
| 33 | (A)-7 | (B)-11 | 550 | 86 | 6.3 | " |
| 34 | (A)-8 | (B)-13 | 540 | 85 | 6.4 | 8,000 |
| 35 | (A)-9 | (B)-15 | 550 | 87 | 6.0 | " |
| 36 | (A)-10 | (B)-18 | 555 | 88 | 6.2 | " |
| 37 | (A)-11 | (B)-19 | 560 | 86 | 6.0 | 10,000 or more |
| 38 | (A)-12 | (B)-24 | 545 | 87 | 6.1 | 10,000 or more |
| 39 | (A)-13 | (B)-49 | 555 | 84 | 6.2 | 10,000 or more |
| 40 | (A)-14 | (B)-2 | 565 | 90 | 5.7 | 8,000 |
| 41 | (A)-16 | (B)-4 | 565 | 89 | 5.8 | " |
| 42 | (A)-17 | (B)-21 | 530 | 83 | 6.5 | " |
| 43 | (A)-18 | (B)-22 | 550 | 82 | 6.9 | 10,000 or more |
| 44 | (A)-20 | (B)-23 | 530 | 82 | 7.3 | 10,000 or more |
| 45 | (A)-23 | (B)-49 | 550 | 87 | 6.2 | 10,000 or more |

As can be seen from the results in Table 11, each of the resulting photoreceptors according to the present invention had excellent charging properties, dark charge retention, and photosensitivity, and provided a clear reproduced image free from background fog even when processed under severe conditions of high temperature and high humidity (30° C., 80% RH).

When an offset printing master plate produced from each of these photoreceptors was used for printing, prints of clear image in the number indicated in Table 11 above could be obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a support having thereon at least one photoconductive layer containing at least an inorganic photoconductive material and a binder resin, wherein the binder resin contains (A) at least one resin having a weight average molecular weight of from $1\times10^3$ to $3\times10^4$ with at least one substituent selected from the group consisting of $—PO_3H_2$, $—SO_3H$, —COOH,

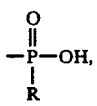

wherein R represents a hydrocarbon group having from 1 to 10 carbon atoms or —OR′, wherein R′ represents a hydrocarbon group having from 1 to 10 carbon atoms, and a cyclic acid anhydride-containing group, being bonded to one of the terminals of the polymer main chain thereof, and (B) at least one resin having a weight average molecular weight of $5\times10^4$ or more and containing, as a polymerization component, at least a repeating unit represented by formula (b-i):

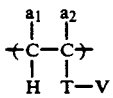

(b-i)

wherein T represents —COO—, —OCO—, $—CH_2OCO—$, $—CH_2COO—$, —O— or $—SO_2—$; V represents a hydrocarbon group having from 1 to 22 carbon atoms; and $a_1$ and $a_2$, which may the same or different, each represents a hydrogen atom, a halogen atom, a cyano group, a hydrocarbon group having from 1 to 8 carbon atoms, —COO—Z, or —COO—Z bonded via a hydrocarbon group having from 1 to 8 carbon atoms, wherein Z represents a hydrocarbon group having from 1 to 18 carbon atoms; and wherein said Resin (B) is partially crosslinked.

2. An electrophotographic photoreceptor as claimed in claim 1, wherein said Resin (A) contains, as a polymerization component, not less than 30% by weight of at least one repeating unit represented by formula (a-i) or (a-ii):

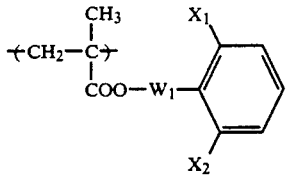

(a-i)

wherein $X_1$ and $X_2$ each represents a hydrogen atom, a hydrocarbon group having from 1 to 10 carbon atoms, a chlorine atom, a bromine atom, $—COY_1$ or $—COOY_2$, wherein $Y_1$ and $Y_2$ each represents a hydrocarbon group having from 1 to 10 carbon atoms, provided that both $X_1$ and $X_2$ do not simultaneously represent a hydrogen atom; and $W_1$ represents a bond or a linking group containing from 1 to 4 linking atoms which connects the —COO— moiety and the benzene ring

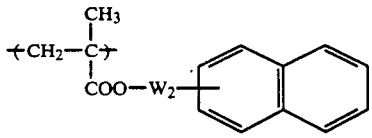

(a-ii)

wherein $W_2$ has the same meaning as $W_1$ above.

3. An electrophotographic photoreceptor as claimed in claim 1, wherein said Resin (B) has at least one polar group selected from the group consisting of $—PO_3H_2$, $—SO_3H$, —COOH, —OH, —SH,

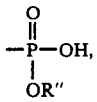

wherein R″ represents a hydrocarbon group, a cyclic acid anhydride-containing group, —CHO, $—CONH_2$, $—SO_2NH_2$ and

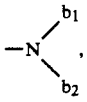

wherein $b_1$ and $b_2$, which may be the same or different, each represents a hydrogen atom or a hydrocarbon group, bonded to only one of the terminals of at least one main chain thereof.

4. An electrophotographic photoreceptor as claimed in claim 1, wherein said Resin (B) does not contain, as a polymerization component, a repeating unit containing said substituent as present in Resin (A).

5. An electrophotographic photoreceptor as claimed in claim 1, wherein the amount of the acidic group bonded to the polymer main chain in the Resin (A) is 0.5 to 15% by weight and the Resin (A) has a glass transition point of from −10° C. to 100° C.

6. An electrophotographic photoreceptor as claimed in claim 2, wherein in the formulae (a-i) and (a-ii), $X_1$ and $X_2$ each represents a hydrogen atom, a chlorine atom, a bromine atom, an alkyl group having up to 4 carbon atoms, an aralkyl group having from 7 to 9 carbon atoms, an aryl group or $—COY_1$ or $—COOY_2$, wherein $Y_1$ and $Y_2$ each represents any of the hydrocarbon group for $X_1$ and $X_2$, with the proviso that $X_1$ and $X_2$ do not simultaneously represent a hydrogen atom;

$W_1$ represents a bond or a linking group containing 1 to 4 atoms and $W_2$ has the same meaning as $W_1$.

7. An electrophotographic photoreceptor as claimed in claim 1, wherein the cyclic acid anhydride group is an aliphatic dicarboxylic acid anhydride group or an aromatic dicarboxylic acid anhydride group.

8. An electrophotographic photoreceptor as claimed in claim 7, wherein said aliphatic dicarboxylic acid anhydride ring is a succinic anhydride ring, a glutaconic anhydride ring, a maleic anhydride ring, a cyclopentane-1,2-dicarboxylic acid anhydride ring, a cyclohexane-1,2-dicarboxylic acid anhydride ring, a cyclohexene-1,2-dicarboxylic acid anhydride ring or a 2,3-bicyclooctanedicarboxylic acid anhydride ring, which rings may be unsubstituted or substituted with at least one of a halogen atom and an alkyl group and said aromatic dicarboxylic acid anhydride ring is a phthalic anhydride ring, a naphthalene-dicarboxylic acid anhydride ring, a pyridine-dicarboxylic acid anhydride ring or a thiophene-dicarboxylic acid anhydride ring, which may be unsubstituted or substituted with at least one of a halogen atom, an alkyl group, a hydroxyl group, a cyano group, a nitro group and an alkoxycarbonyl group.

9. An electrophotographic photoreceptor as claimed in claim 1, wherein said inorganic photoconductive material is zinc oxide.

* * * * *